United States Patent [19]

Roloff

[11] Patent Number: 4,870,742

[45] Date of Patent: Oct. 3, 1989

[54] COIL WINDING MACHINE

[75] Inventor: Frederick W. Roloff, Milwaukee, Wis.

[73] Assignee: Cooper Power Systems, Inc., Houston, Tex.

[21] Appl. No.: 279

[22] Filed: Jan. 2, 1987

[51] Int. Cl.[4] ..... B21F 3/027; B21F 3/04; H01F 41/04

[52] U.S. Cl. ..... 29/335; 29/469.5; 29/605; 72/139; 140/92.2

[58] Field of Search ..... 29/335, 734, 605, 469.5; 409/137; 72/139, 142, 144; 140/92.2

[56] References Cited

U.S. PATENT DOCUMENTS

| | | | |
|---|---|---|---|
| 1,396,033 | 11/1921 | Francis | 140/92.2 |
| 3,162,391 | 12/1964 | Westcott et al. | 140/92.2 |
| 3,166,104 | 1/1965 | Foley, Jr. et al. | 140/92.2 |
| 3,628,241 | 12/1971 | Toyoda et al. | 29/605 |
| 3,991,462 | 11/1976 | Engel | 29/605 |
| 4,279,277 | 7/1981 | Peck, Jr. et al. | 140/92.2 |
| 4,381,852 | 5/1983 | Ferree et al. | 140/92.2 X |

FOREIGN PATENT DOCUMENTS

| | | | |
|---|---|---|---|
| 513720 | 1/1941 | United Kingdom | 72/137 |
| 1023287 | 3/1966 | United Kingdom | 140/92.2 |

*Primary Examiner*—Z. R. Bilinsky

*Attorney, Agent, or Firm*—Quarles & Brady

[57] ABSTRACT

A coil winding machine for winding a bar type conductor into a coil. The conductor is withdrawn from a reel by a feeding mechanism and passes through a straightening mechanism which also positions the conductor in both a horizontal plane of reference and a vertical plane of reference which is maintained while the conductor is progressing through the machine. An encoder measures the length of the conductor as it passes by and when the required length is measured the cut-off mechanism is actuated to cut the conductor. The conductor moves a taping assembly that applies insulating tape to both edges of the conductor for insulating adjacent turns from each other in the completed coil. A bending mechanism then bends the leading end of the conductor at an angle to the length of the conductor to form a terminal for the coil. This bent end is then clamped to the mandrel. As the mandrel is rotated it is also moved axially to wind the conductor about it in a helical path to form the coil. When the trailing end of the conductor arrives at the bending mechanism it is also bent to form the second terminal of the coil. The mandrel is expandable radially to receive the conductor and wind the coil and is retractable radially to release the completed coil for removal. The mandrel is also split radially so that the two portions can be separated for removal of the completed coil.

26 Claims, 12 Drawing Sheets

30
32
40
31
33
41
41
35
36
37

37

COIL WINDING MACHINE

The present invention relates to coil winding machines and more particularly to machines that strip a bar conductor off a reel, process such conductor and then wind it into a coil for use in electrical apparatus, such as transformers.

It is the practice in the electrical transformer industry to wind bar type conductors into a coil with a suitable insulating material between the individual turns to electrically insulate the individual turns from one another. Such bar conductors are formed of a good conductor of electricity, such as copper or aluminum and are of substantial cross sectional area to enable them to carry the heavy electrical loads to which they are subjected. For example, an aluminum bar type conductor may be more than one-half inch in thickness and as much as one and one-half inches in width. A machine designed to process such heavy conductors into a coil must develop substantial power to manipulate the conductor in the process of strapping it into a coil. Therefore, any improvement in the process results in a material advantage to the overall system.

It has been the accepted practice in coil winding machines of the present type to form the coil over a revolving mandrel and move the conductor along the axis of the mandrel as it is revolving to form the helical winding. This presents the problem of shifting the heavy conductor and portions of the winding machine along the length of the mandrel. Such problem is eliminated in the present invention by moving the mandrel along its axis of rotation while it is rotating to form the helical winding. This arrangement simplifies the construction of the machine and provides much better control over the formation of the turns in the coil.

Another feature of the invention lies in the improved control provided over the removal of the conductor from the storage reel on which it is contained for supplying the machine. When stripping the conductor off of the reel there is a tendency for the reel to overrun, causing misalignment of the conductor. The present invention overcomes such tendency of the reel by coupling a biasing motor to the reel and applying a torque to the reel in a direction opposing the rotation of the reel in the direction that feeds the conductor to the machine. The feeding mechanism that draws the conductor from the reel will overcome the torque developed by the biasing motor, but during the entire operation, the biasing motor will maintain the conductor taut between the reel and the feeding mechanism.

It is also important in the coil winding machine of the present invention that the conductor be retained in accurate alignment as it advances through the several operating mechanisms of the machine. The first station in the machine serves to straighten the conductor for subsequent processing. To this end, the conductor is forced against fixed rollers that have their axes in a horizontal plane as well as against fixed rollers that have their axes in a vertical plane. The peripheries of these fixed rollers serve to accurately align the conductor in two planes of reference as it enters the coil winding machine, and this alignment is accurately maintained as the conductor progresses through the several operating mechanisms of the machine.

SUMMARY OF THE INVENTION

The bar type conductor processed by the coil winding machine of the present invention is supplied to the machine from a reel. While the conductor is being stripped from the reel a torque is applied to the reel in a direction yieldably opposing the rotation of the reel in the direction that permits the conductor to be fed into the machine. This provides continuous control over the rotation of the reel as well as of the movement of the conductor.

From the reel the conductor is moved directly into the straightening mechanism where the conductor is straightened in both the vertical and horizontal planes. A series of rollers journaled for rotation about laterally movable vertical axes cooperate with a complementary set of rollers that are journaled for rotation about fixed vertical axes. These fixed vertical axes rollers establish the vertical plane of reference of the conductor used and the position of the conductor in this vertical plane of reference is maintained as the conductor progresses through the several assemblies of the machine. In like manner, a series of rollers journaled for rotation about laterally movable horizontal axes cooperate with a complementary set of rollers that are journaled for rotation about fixed horizontal axes. The fixed horizontal axes rollers establish the horizontal plane of reference of the conductor and the location of the conductor in the horizontal plane of reference is maintained as the conductor moves through the machine.

From the straightening mechanism the conductor moves into the feed mechanism which draws the conductor off of the reel and through the straightening mechanism and then feeds it into the remaining assemblies of the machine. As the conductor moves out of the feed mechanism it activates an encoder that measures the length of conductor moving out of the feed mechanism. A saw is operably mounted adjacent to the encoder and after the encoder measures the prescribed length of conductor moving past, the feed mechanism is halted and the saw is operated to cut the conductor. At this point the required length of conductor has been fed into the machine to form the coil.

The feed mechanism moves the conductor past the saw and into a taping mechanism where an insulating tape is applied to the sides and corners of the rectangular conductor for the purpose of insulating the turns from each other.

Both ends of the finished coil are bent to present terminals that extend transversely to the winding to provide a means for making an electrical connection to the winding. These bends are formed by a bending mechanism which receives the conductor from the taping mechanism and bends the leading end before the conductor is introduced to the mandrel and the trailing end after the conductor is partially wound about the mandrel.

The bend in the leading end of the conductor is automatically clamped to the mandrel and the mandrel is rotated to wind the conductor about the mandrel. As the mandrel is rotating it is fed axially at a controlled rate so that the conductor is wound about the mandrel in a helical path to produce the helical turns that form the coil. A pair of rollers apply pressure to the conductor to force it against the surface of the mandrel so that the finished coil assumes the shape of the mandrel.

When the winding of the coil is completed the longitudinal sections forming the mandrel are retracted to reduce the cross sectional dimensions of the mandrel to release the finished coil. The mandrel is also split radially so that the two portions can be separated to permit removal of the finished coil from the mandrel.

The foregoing and other objects of this invention, which will become more fully apparent from the following detailed description, may be achieved by means of the examplifying apparatus depicted in and set forth in this specification in connection with the accompanying drawing.

BRIEF DESCRIPTION OF THE DRAWING

FIG. 18 is a front elevational view showing the mandrel and its operating mechanism;

Figure 1:
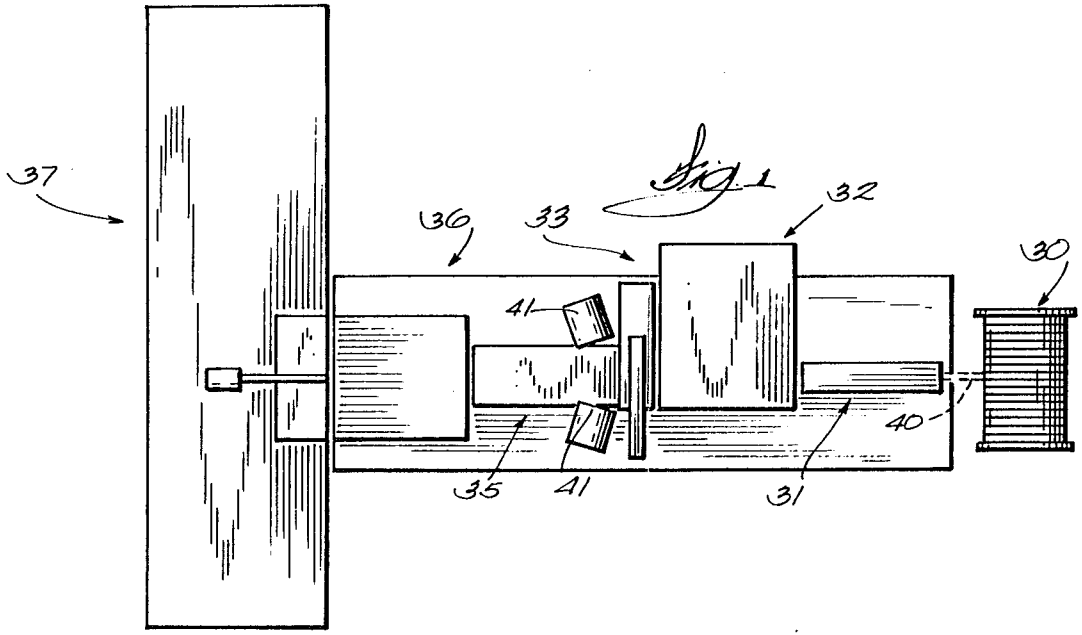
FIG. 1 is a schematic representation of the complete coil winding machine of the present invention.
Figure 1B:
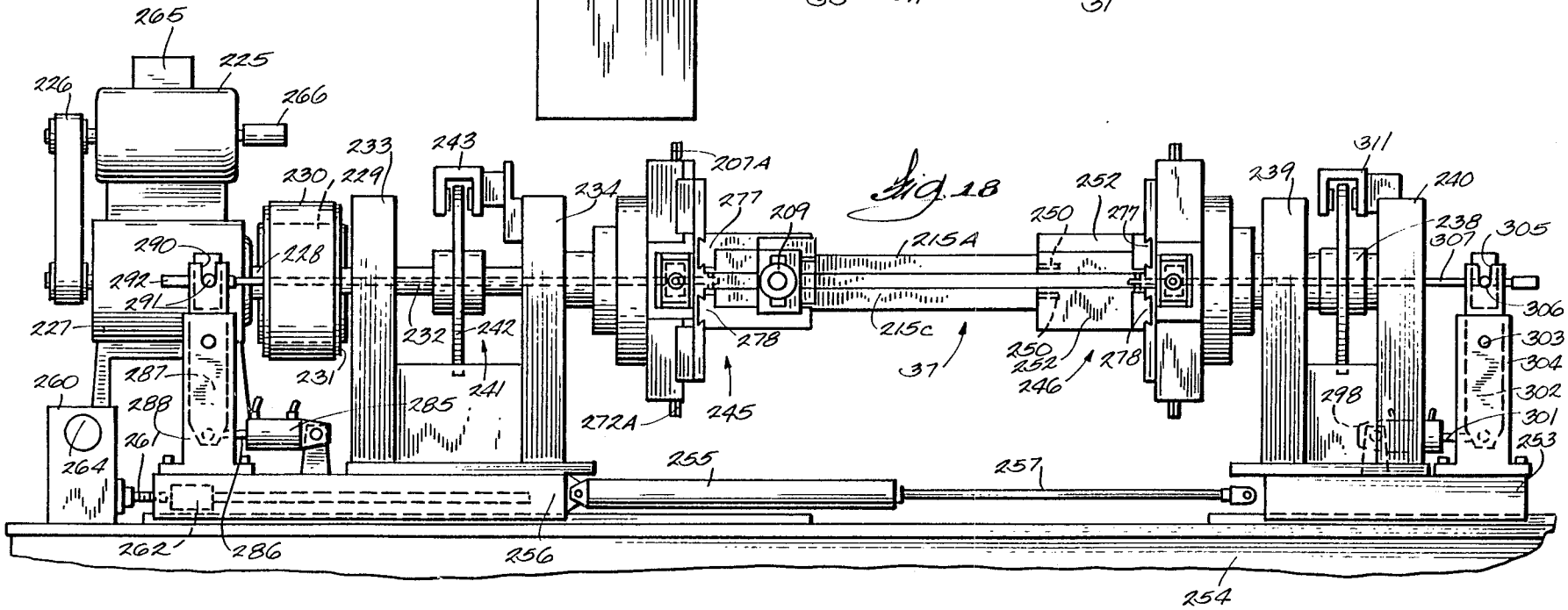
Figure 17:
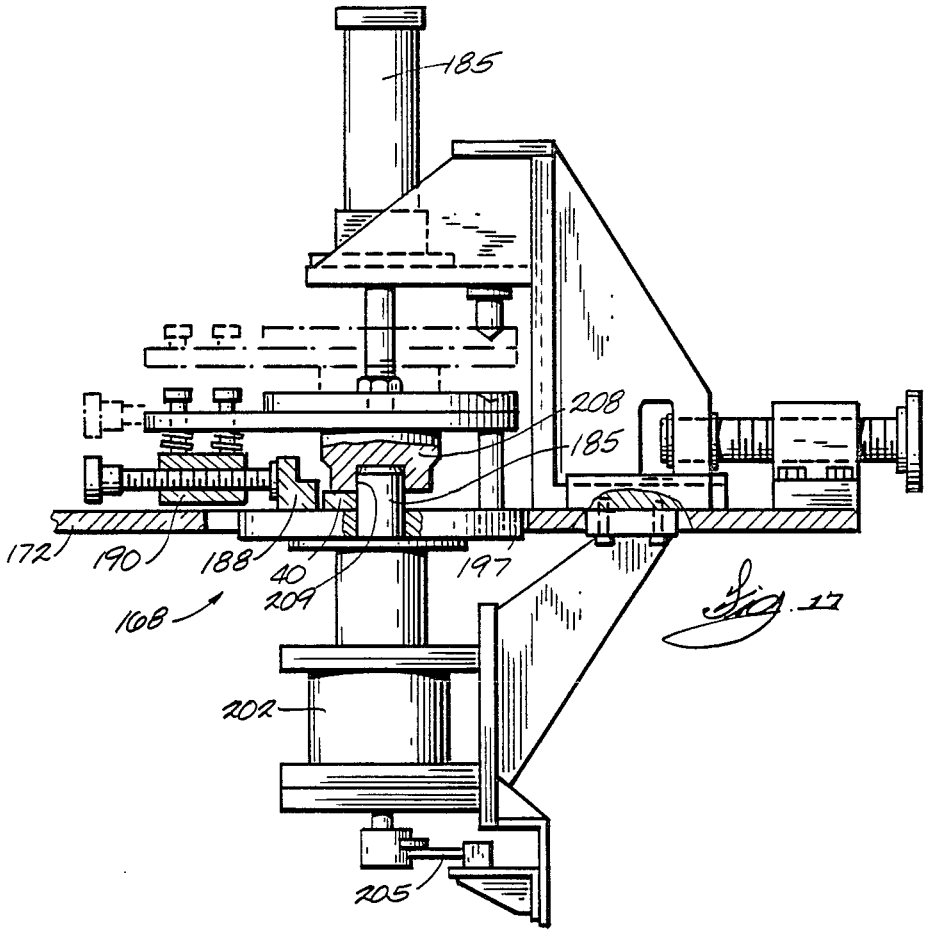
FIG. 17 is a view mostly in elevation taken along the plane represented by the line 17—17 in FIG. 13.

Reference is now made more particularly to the drawing and specifically to FIG. 1 thereof which is a schematic representation of the complete machine assembly. As there shown, the coil winder of the present invention comprises a reel generally identified by the reference numeral 30 and which serves as a store for the bar type conductor furnished to the machine as required. The bar type conductor is manufactured in various cross sectional dimensions, depending upon the amount of voltage it is required to carry. Aluminum conductor to be wound into coils by the machine may be more than ½ inch in thickness and 1½ inches in width.

The heavy bar type conductor coiled by the machine of the present invention and stored on the reel 30 requires straightening before it can be processed into a coil. To this end, a bar type conductor 40 stripped from the reel 30 is passed through a straightening mechanism generally identified by the reference numeral 31. The straightening mechanism not only straightens the conductor 40 but also locates it in a vertical plane of reference as well as in a horizontal plane of reference. This positioning of the conductor is maintained as it passes through the various mechanisms of the machine.

A feeding mechanism 32 is provided for withdrawing the conductor 40 from the reel 30 and through the straightening mechanism 31. As the conductor 40 is passing through the feeding mechanism 32 it operates an encoder 38 which measures the length of the conductor being fed into the machine. The encoder 38 transmits electrical pulses representing the length of conductor 40 passing by to a control 265. When the prescribed length of conductor has been registered by the control 265, the feeding mechanism 32 is stopped and the conductor is severed by a cutoff saw 33. Thus, the cutoff saw 33 establishes the length of conductor 40 that will be wound into a coil by the machine.

The individual turns of the finished coil must be insulated from each other and therefore an insulating tape 41 is applied to the edges of the conductor 40 so that each individual turn is adequately insulated from the adjacent turns. The tape 41 is applied to the conductor 40 by a taping system generally identified by the reference numeral 35.

After the tape 41 has been applied to the conductor, the latter is received by a bending mechanism generally identified by the reference numeral 36. Both the leading and the trailing ends of the length of conductor forming each coil must be bent 90 degrees to the length of the conductor to form the terminals on the coil. These bends are formed by the bending mechanism 36.

After the bend in the leading end of the length of conductor is completed, the conductor is moved into a mandrel generally identified by the reference numeral 37. The bend formed in the leading end of the conductor is clamped to the mandrel 37 and the latter then rotates while it is being fed axially at a controlled rate.

As the mandrel rotates it draws the conductor 40 from the reel 30 until it is sawed and then draws it through the taping mechanism 35 and the bending mechanism 36. The conductor 40 with the tape 41 applied is then wound about the mandrel in a helical path to form the helical turns that establish the coil.

THE REEL

Figure 2:
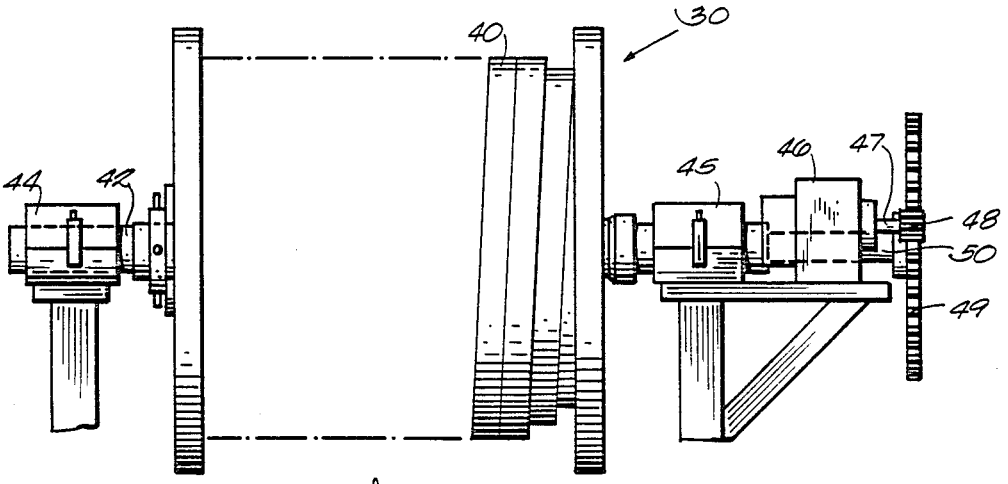
FIG. 2 is an elevational view of the conductor supply reel which supplies the conductor to the machine.

The reel 30 is best shown in FIG. 2 where it is illustrated with the conductor 40 wound about it and mounted on a shaft 42. The shaft 42 is journaled in bearings 44 and 45 and is free to rotate therein. The shaft 42 is coupled to a drive gear 49 that is in meshing engagement with a pinion 48 that is keyed to the output shaft of a torque motor 46. The torque motor 46 therefore is coupled to apply a biasing torque to the reel 30 in a direction to oppose its rotation in the direction for feeding the conductor 40 to the machine.

The motor 46 is preferably a pneumatic motor that will apply a torque to the reel 30 but yield to the forces that rotate the reel 30 in a direction for supplying the conductor 40 to the machine.

STRAIGHTENING MECHANISM

Figure 3:
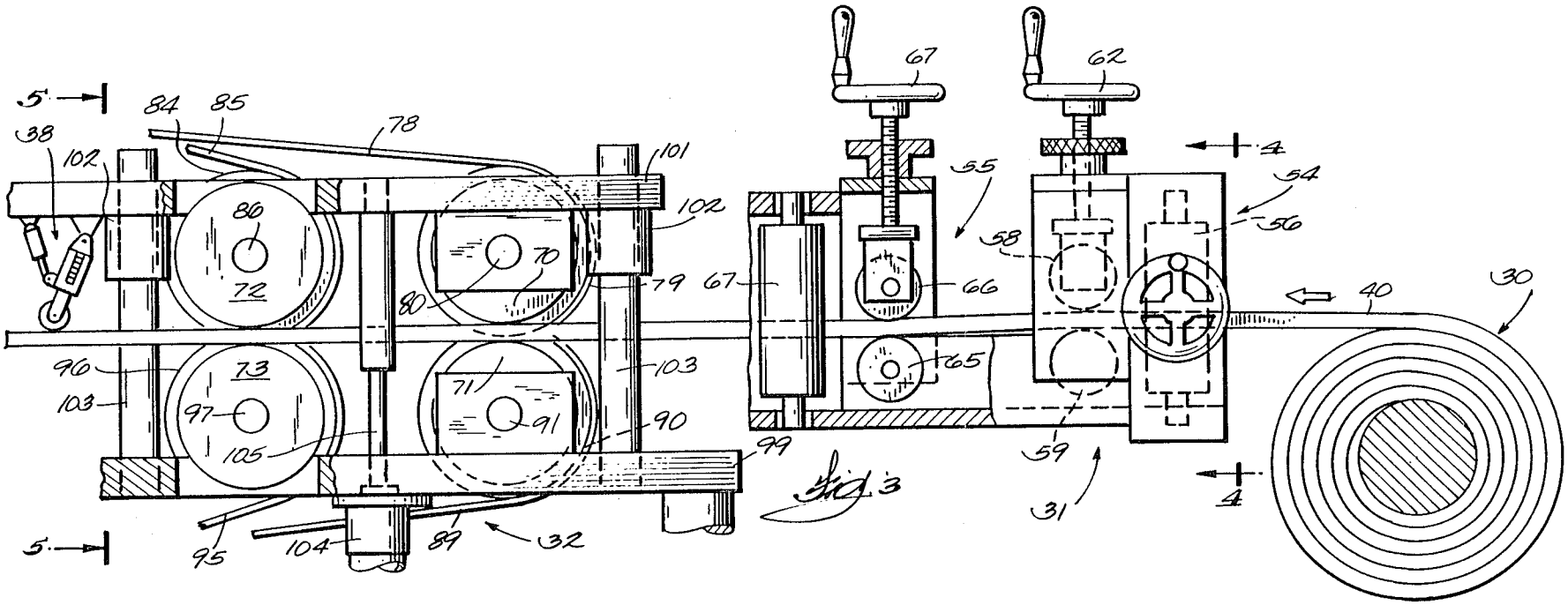
FIG. 3 is a combined side elevational view of the straightening mechanism and the feeding mechanism with parts broken away to illustrate the operating mechanism.
Figure 4:
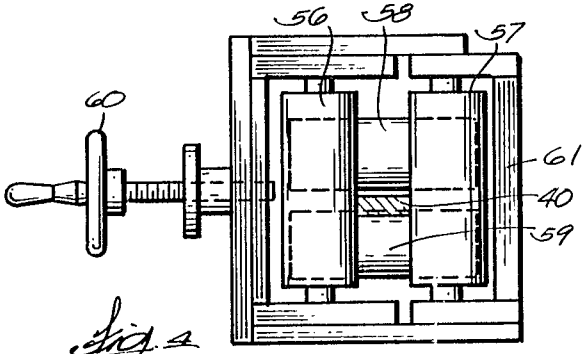
FIG. 4 is a view partly in elevation and partly in vertical section taken along the plane represented by the line 4—4 in FIG. 3.

As previously mentioned, in order to remove all of the kinks and bends in the conductor 40 as it comes off of the reel 30 it is passed through the straightening mechanism 31 which is illustrated in FIGS. 3 and 4. As there shown, the conductor 40 passes through two sets of rollers generally identified by the reference numerals 54 and 55 respectively. As the conductor 40 comes off of the reel 30 it passes through the set of rollers 54 which perform the first straightening operation. To this end, the conductor 40 first passes through a pair of vertical rollers 56 and 57 which straighten the conductor 40 in one direction. From the rollers 56 and 57 the conductor 40 passes between a pair of horizontal rollers 58 and 59 which serve to straighten the conductor 40 in the horizontal direction.

It should be noted that, as best shown in FIG. 4, the vertical roller 56 is adjustable by rotating a hand crank 60 to vary its position in the housing 61 for varying the spacing between the two rollers 56 and 57 to accommodate the width of the conductor 40 being processed. On the other hand, the roller 57 is rotatively supported in the housing 61 but its axis is fixed therein. Therefore, the periphery of the roller 57 establishes the vertical plane of reference for the conductor 40 and regardless of the dimensions of the conductor 40, the vertical plane of reference will always remain the same. This location of the conductor 40 is maintained as the conductor 40 progresses through the several mechanisms of the machine.

In like manner the bottom roller 59 is journaled in the housing 61 with its axis of rotation being fixed so that its periphery establishes the horizontal plane of reference for the conductor 40. This horizontal position of the conductor 40 is also maintained as it progresses through the several assemblies of the machine. On the other hand, the top horizontal roller 58 is adjustable by rotating a hand crank 62 for adjusting the spacing between the two rollers 58 and 59 to accommodate the thickness of the conductor 40 being processed.

The straightening operation is completed by passing the conductor 40 through the second set of rollers 55. As shown in FIG. 3, the second set of rollers 55 also includes a pair of horizontal rollers 65 and 66 and a pair of vertical rollers with only the vertical roller 67 being shown. The horizontal roller 66 is adjustable by revolving a hand crank 67 to accommodate for the different thicknesses in the conductor 40 being processed. On the other hand, the roller 65 revolves about a fixed axis so that it maintains the horizontal plane of reference established by the roller 59. In like manner the vertical roller 67 is adjustable to accommodate for different widths of the conductor 40 while its cooperating vertical roller (not shown) revolves about a fixed axis to maintain the vertical plane of reference established by the vertical roller 57.

FEED MECHANISM

Figure 5:
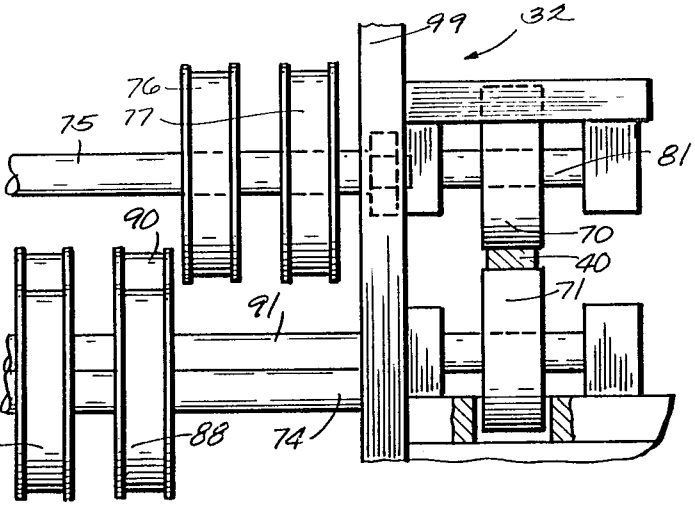
FIG. 5 is a view partly in elevation and partly in section illustrating a portion of the feeding mechanism.

The conductor 40 is drawn off of the reel 30 and through the straightening mechanism 31 by the feed mechanism 32 as clearly shown in FIG. 3. The feeding operation is performed by two pairs of cooperating rollers, the conductor 40 being first engaged by a pair of rollers 70 and 71 which then move the conductor into engagement with a second pair of rollers 72 and 73. All four rollers 70, 71, 72 and 73 are driven by power from a motor (not shown) which drives a pair of drive shafts 74 and 75 that are rotated in opposite directions as shown in FIG. 5. The drive shaft 75 includes a pair of pulleys 76 and 77 that are connected to drive the two top rollers 70 and 72. To this end, the pulley 76 is connected by a drive belt 78 to a pulley 79 that is keyed to drive a shaft 80, which, in turn, is keyed to drive the roller 70.

The other top roller 72 is driven by the pulley 77 which is connected to drive a pulley 84 by means of a drive belt 85. The pulley 84 is keyed to a shaft 86 which, in turn, is keyed to drive the roller 72 so that the pulley 84, the shaft 86 and the roller 72 rotate in unison.

The lower shaft 74 shown in FIG. 5 drives a pair of pulleys 87 and 88 that are connected to drive the two lower feed rollers 71 and 73. To this end, the pulley 88 is engaged by a drive belt 89 that is also in engagement with a pulley 90. The pulley 90 is keyed to a shaft 91 that is also keyed to the roller 71 so that the pulley 90, the shaft 91 and the roller 71 all rotate in unison. Moreover, the lower roller 71 rotates at the same speed as the upper roller 70.

The other pulley 87 on the shaft 74 is connected to drive the lower roller 73. A drive belt 95 is in engagement with the pulley 87 and with a second pulley 96 that is keyed to a shaft 97 which, in turn, is keyed to the roller 73. Therefore, the conductor 40 is engaged between both feed rollers 71 and 70 which advance the conductor to the two feed rollers 72 and 73. All four rollers are under power and they serve to draw the conductor 40 off of the reel 30 and through the straightening mechanism 31 and then advance the conductor 40 to the several assemblies of the machine.

The two lower rollers 71 and 73 are mounted on the shafts 91 and 97 respectively which are journaled in a frame 99, a portion of which is illustrated in FIG. 5. The two top rollers 70 and 72, however, are journaled in a movable bracket 101 that includes a plurality of sleeves 102, two of which are illustrated in FIG. 3. The sleeves 102 are slidably mounted on posts 103 that are supported by the frame 99. Accordingly, the bracket 101 is slidably supported by the sleeves 102 on the posts 103.

Figure 8:
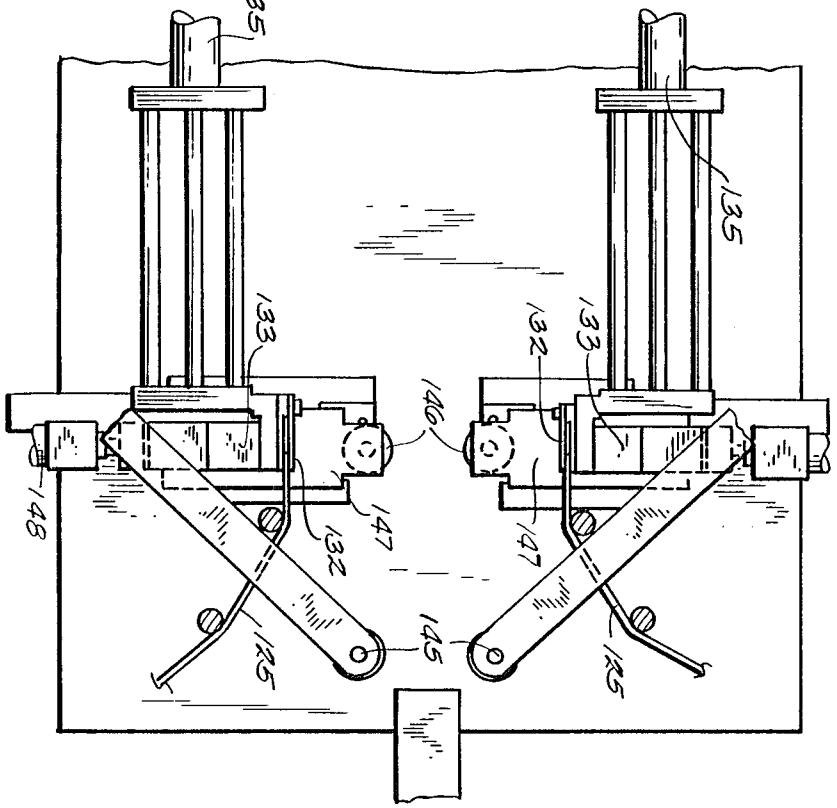
FIG. 8 is a fragmentary plan view showing the tape advancing mechanism gripping the tape as it is held by the tape clamp.

The bracket 101 is connected to a hydraulic piston and cylinder mechanism 104 by means of a coupling 105 as shown in FIG. 8. When the conductor 40 is being fed through the machine, the hydraulic cylinder 104 is energized to draw the bracket 101 downwardly for biasing the upper rollers 70 and 71 against the conductor 40 which, in turn, is forced against the lower rollers 71 and 73. Thus, the conductor 40 is in tight frictional engagement with the four rollers so that as the latter are rotated they withdraw the conductor 40 from the reel 30 and advance it along the predetermined paths through the machine.

After the encoder 38 has measured the prescribed length of conductor 40 fed to the machine, a control 265 actuates the cut-off saw 33 to sever the conductor 40. The saw 33 comprises a rotary cutting blade 117 that is rotatably supported and coupled to be driven by a motor 118 that is in driving engagement with the blade 117 by means of a belt 119 that is entrained over suitable pulleys 120 and 121. A piston and cylinder mechanism 122 advances the rotating saw blade 117 to cut off the conductor 40. Upon completion of the cutting operation the piston and cylinder mechanism retracts the saw to its idle position.

The feeding mechanism 32 advances the conductor 40 past the saw 33 into the taping system 35 where an insulating tape 125 is applied to the edges of the conductor 40. The tape 125 is applied to both edges of the conductor 40 and therefore the same tape applying structure is provided on both sides of the conductor 40 as it advances through the taping system. Therefore, the structure on one side of the conductor 40 will be described, but it should be understood that the identical structure operates on the other side of the conductor 40 and the same reference numerals will be applied to identical parts.

At the beginning of the taping operation, the end of the tape is gripped between the jaws of a tape holder 126 with a short length of tape extending beyond the jaws of the holder. A tape advancing mechanism generally identified by the reference numeral 130 is shown in the retracted position in FIG. 6. The tape advancing mechanism 130 includes a frame 131 that carries a grip 132 for gripping the end of the tape extending from the holder 126. The grip 132 is actuated for gripping and releasing the tape 125 by a piston and cylinder mechanism 133.

The frame 131 which carries the grip 132 is coupled to a piston and cylinder mechanism 135 that serves to advance the grip 132 to the tape holder 126, as shown in FIG. 8. The grip 132 moves into engagement with the extending end of the tape 125 and the piston and cylinder mechanism 133 is then actuated to close the grip 132 for gripping the tape. The jaws of the holder 126 are then opened to release the tape and the piston and cylinder mechanism 135 is retracted to move the grip 132 away from the holder 126 to the position shown in FIG. 6 for advancing the tape.

Figure 6:
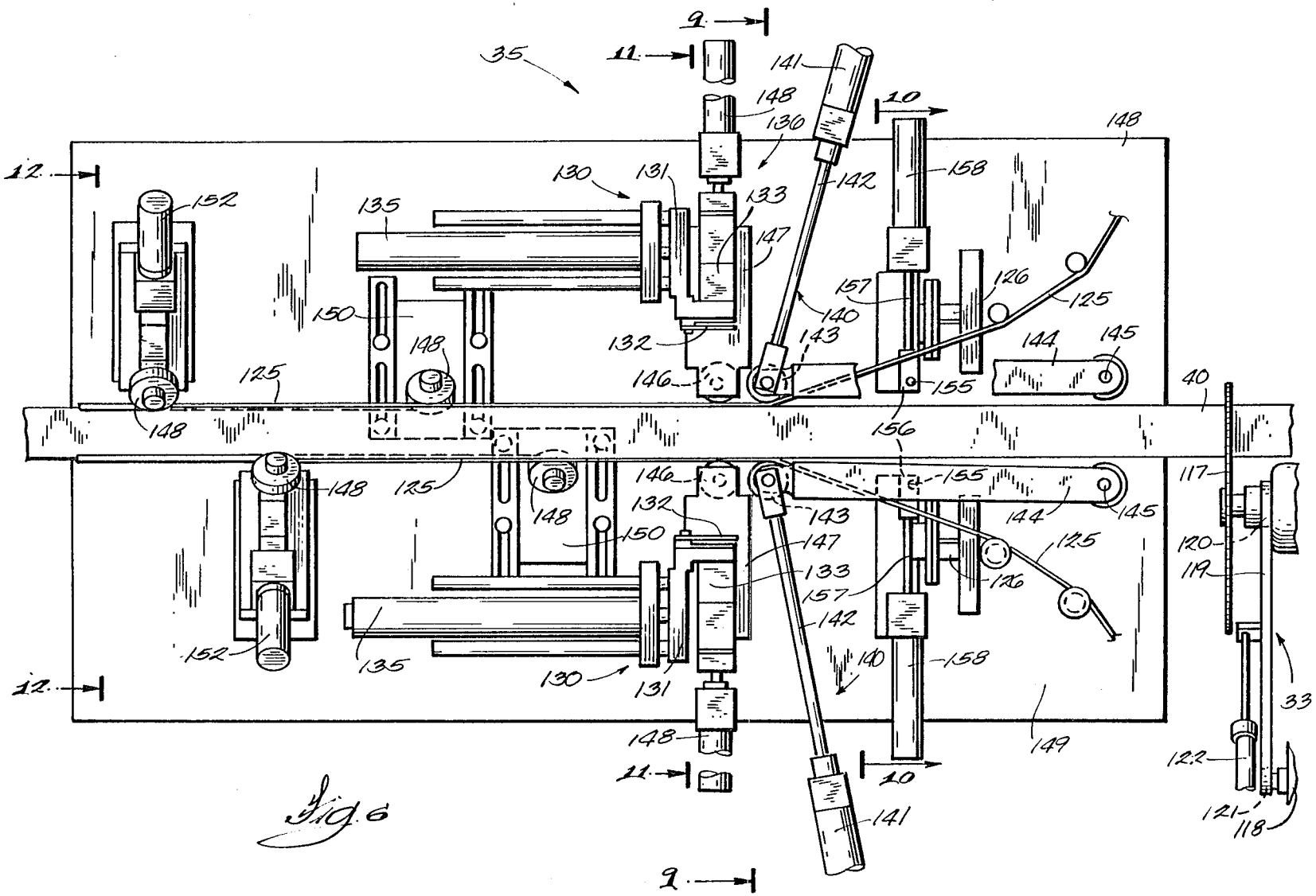
FIG. 6 is a plan view depicting the taping system for applying insulating tape to the edges of the conductor.
Figure 9:
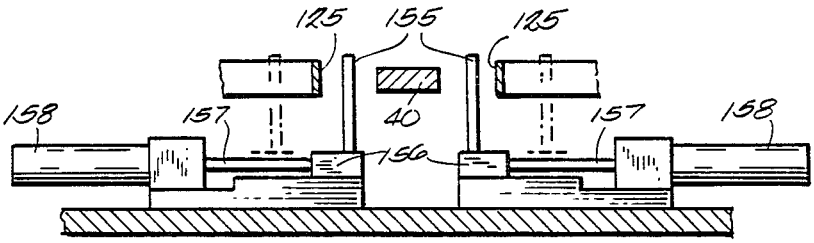
FIG. 9 is a view mostly in elevation taken along the plane represented by the line 9—9 in FIG. 6.

The tape has now been advanced forwardly, but it is spaced from the conductor 40 as shown in FIG. 9. The grip 132 is then opened to release the tape and a placement mechanism generally identified by the reference numeral 140 is actuated to move the tape from the position shown in FIG. 9 into engagement with the edge of the conductor 40 as shown in FIG. 6. The placement mechanism 140 comprises a piston and cylinder mechanism 141 including a piston rod 142 with a roller 143 journaled in its extending end. The extending end of the piston rod 142 is also coupled to a link 144 which is pivotally supported at its opposite end by a pin 145. The link 144 serves to retain the piston rod 142 and its associated roller 143 in position but permits the roller 143 to be moved in an arc toward and away from the conductor 40. The movement of the placement roller 143 shifts the tape so that its pressure sensitive adhesive side is moved into engagement with the edge of the conductor 40.

In order to obtain good adhesion of the tape to the edge of the conductor 40, a pressure roller 146 is shifted into engagement with the tape to apply pressure to it for forming a binding connection between the tape and the edge of the conductor 40. The pressure roller 146 is journaled in a frame 147 that is slidably supported by a bed 149. The frame 147, in turn, is coupled to a piston and cylinder mechanism 148 which is operable to retract the roller 146 away from the conductor 40. However, after the tape is moved into placement with the edge of the conductor 40, the piston and cylinder mechanism 148 advances the roller 146 into engagement with the tape on the edge of the conductor 40 and applies pressure to it for tightly binding the tape 125 to the conductor 40.

The tape 125 is wider than the thickness of the conductor 40 so that it can be folded around the corner of the conductor and onto its top and bottom surfaces. This operation is performed by four corner placement rollers 153 with each of the rollers operating on one of the four corners of the conductor 40. A notch 154 extends about the periphery of each of the rollers 153 and the notch forms a 90° angle so that pressure is applied to both sides of each of the corners of the conductor 40. Each of the rollers 153 is journaled on a separate slide 150 that is slidably supported by brackets 151. A separate piston and cylinder mechanism 152 is coupled to each of the slides 150. The piston and cylinder mechanisms 152 serve to retract the associated roller 153 from the conductor 40 and when required, advance its associated roller 153 into engagement with the corner of the conductor 40. Moreover, while the conductor 40 is advancing through the machine, pressure is applied to the rollers 153 by their associated piston and cylinder mechanisms 152 to tightly bind the tape 125 to the conductor 40.

After the encoder 38 has measured the passage prescribed amount of conductor, the saw cuts the conductor 40 to establish the trailing end of the length of conductor forming a coil. The tape 125 is likewise coming off of a supply roll and must be cut when sufficient tape has been withdrawn from the supply to cover the entire length of the conductor 40. When this point is reached, the cylinder 141 retracts the placement roller 143 to release the tape 125. The tape 125 must then be retracted from the conductor 40 and to this end, a retracting pin 155 is mounted to extend upwardly from a support 156 that is secured to the end of a piston rod 157 of a piston and cylinder mechanism 158.

Figure 7:
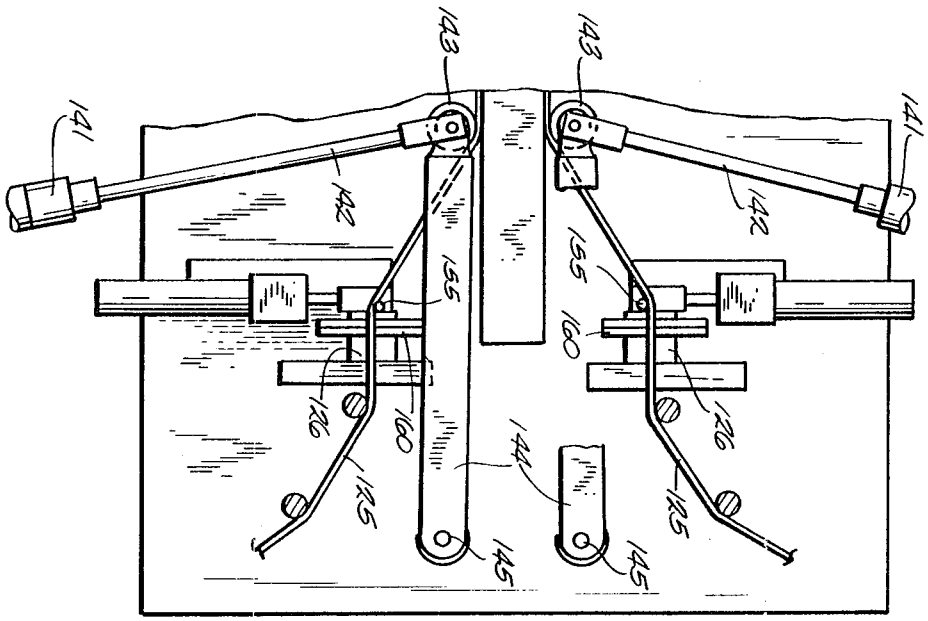
FIG. 7 is a fragmentary view illustrating the location of the placement rollers after they have placed the tapes against the edges of the conductor.

During the taping operation the piston rod 157 is extended to locate the retracting pin 155 between the advancing tape 125 and the conductor 40. When the taping operation is completed, and the placement roller 143 is retracted, the piston and cylinder mechanism 158 also retracts the retracting pin 155 to locate the tape directly above the holder 126 and a pair of scissors 160 as best shown in FIG. 7. This brings a portion of the tape 125 into alignment with both the holder 126 and the scissors 160. A piston and cylinder mechanism 161 is coupled to the frame that supports both the scissors 160 and the holder 126. Accordingly, operation of the piston and cylinder mechanism 161 serves to either raise or lower the holder 126 and the scissors 160. When the retracting pin 155 moves the tape into alignment with the scissors 160 and the holder 126, the scissors and holder are in their lower position. Moreover, the jaws of the holder 126 and the two blades of the scissors 160 are in their open position. The piston and cylinder mechanism 161 is then actuated to raise both the holder 126 and the scissors 160 so that the tape 125 is now between the two blades of the scissors 160 and the two jaws of the holder 126.

Figure 10:
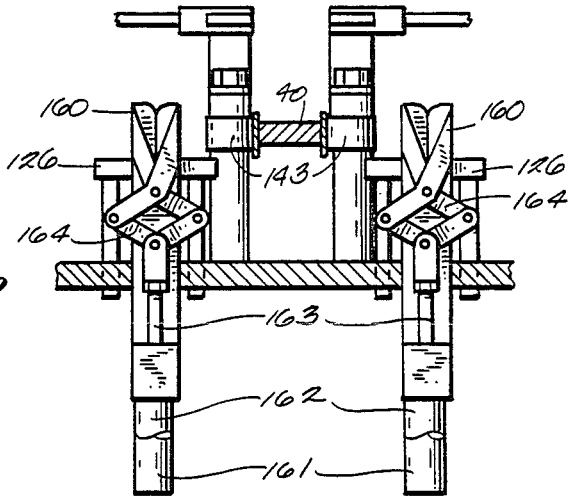
FIG. 10 is a view mostly in elevation taken along the plane represented by the line 10—10 in FIG. 6.
Figure 11:
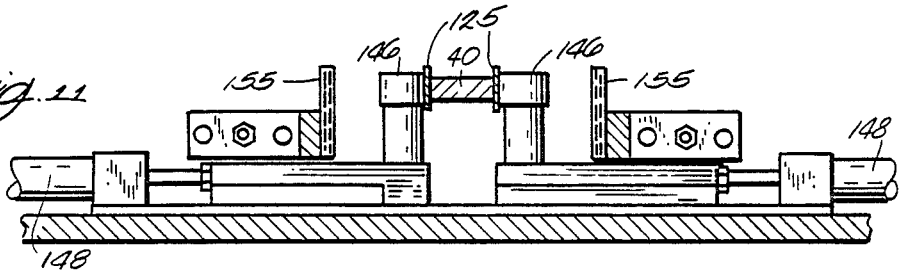
FIG. 11 is a view mostly in elevation taken along the plane represented by the line 11—11 in FIG. 6.
Figure 12:
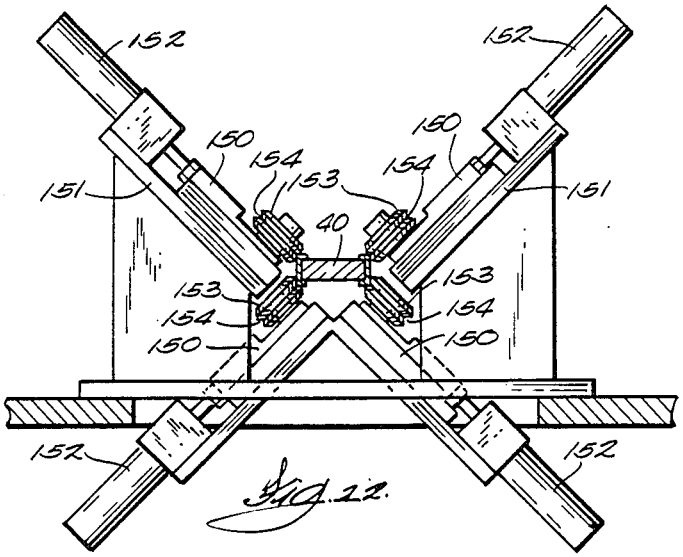
FIG. 12 is a view mostly in elevation taken along the line 12—12 in FIG. 6.

The blades of the scissors 160 and the jaws of the holder 126 are operated by a second piston and cylinder mechanism 162 as best shown in FIG. 10. A piston rod 163 of the piston and cylinder mechanism 162 is coupled to a parallel linkage 164 so that when the piston rod 163 is extended, the blades of the scissors 160 and the jaws of the holder 126 are open. On the other hand, when the piston rod 163 is retracted into the piston and cylinder mechanism 162 the parallel linkage 164 operates to close both the blades of the scissors 160 and the jaws of the holder 126 as shown in FIG. 10. Accordingly, after the tape 125 has been positioned as shown in FIG. 7, and the holder 126 as well as the scissors 160 have been moved to their uppermost position, the piston and cylinder mechanism 162 is actuated to close the jaws of the holder 126 to secure the tape. The blades of the scissors 160 are likewise closed to cut the end of the tape, leaving a portion extending from the holder 126. The tape is now ready for the next taping operation.

BENDING MECHANISM

Figure 13:
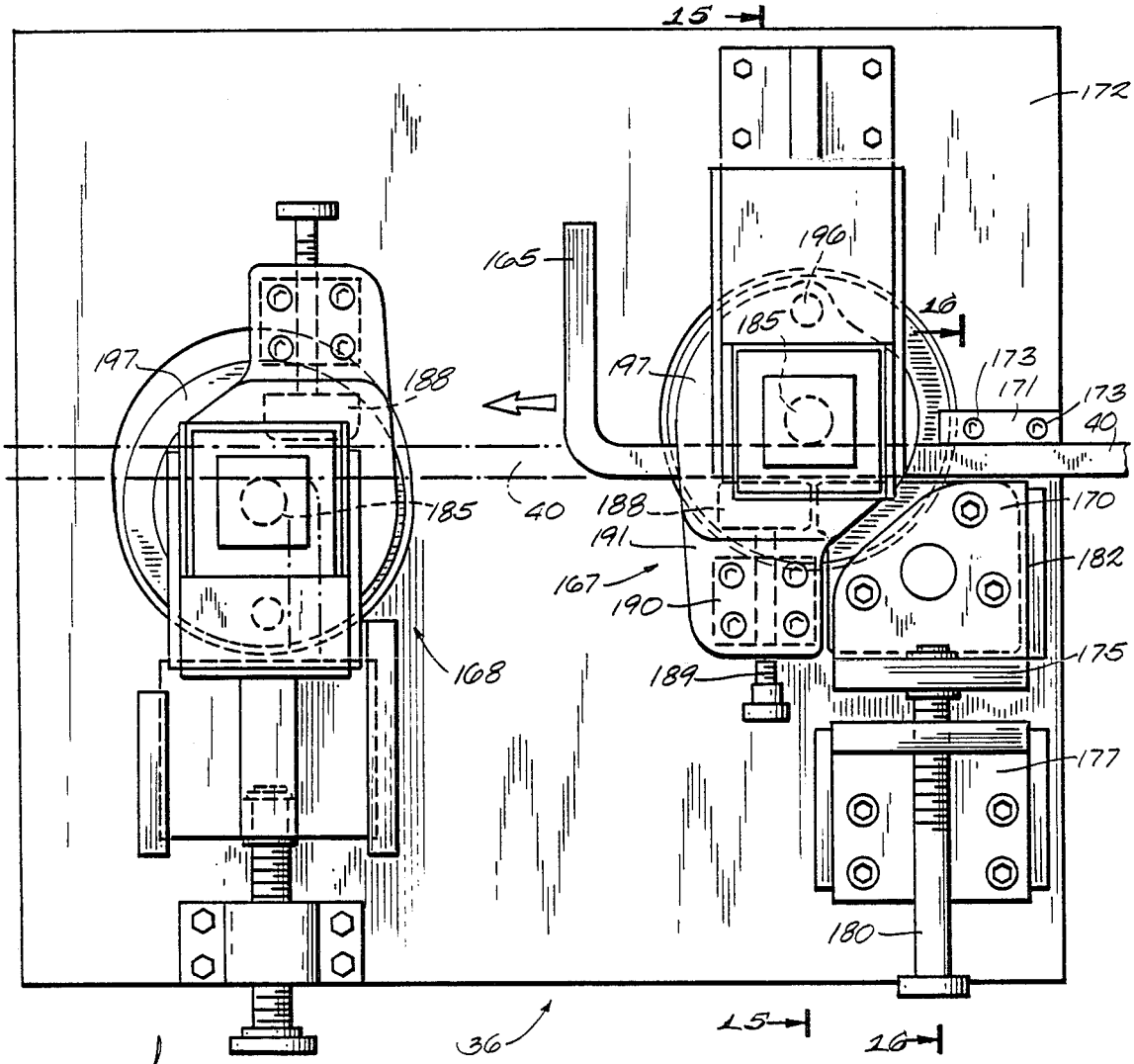
FIG. 13 is a plan view of the bending mechanism for bending the ends of the conductor to form the terminals for the coil.

After the tape 125 has been applied to the conductor 40, the latter passes through the bending mechanism 36 which serves to bend the leading end of the length of conductor 40 required to form a coil. The leading end is bent substantially 90° in one direction to establish a terminal 165 for the completed coil. In like manner, the trailing end of each such length of conductor is bent substantially 90° in the opposite direction to form another terminal 166 as shown in FIG. 13. The bending mechanism 36 actually comprises two separate bending assemblies generally identified by the reference numerals 167 and 168. The assembly 167 serves to produce the bend on the leading end of the length of conductor 40 while the assembly 168 functions to produce the bend on the trailing end of the length of conductor 40.

Figure 16:
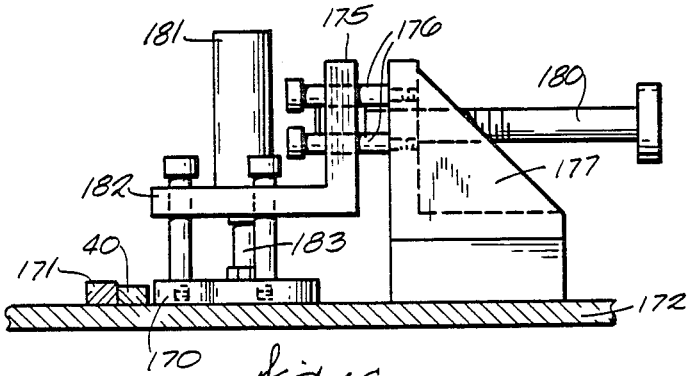
FIG. 16 is a view mostly in elevation taken along the plane represented by the line 16—16 in FIG. 13.

After the tape 125 has been applied, the conductor 40 enters the bending mechanism where it is positioned by a pair of guides 170 and 171 as best shown in FIGS. 13 and 16. The guide 171 is fixed to a base 172 by a pair of screws 173 and its inner edge is located along the horizontal reference plane as established by the straightening mechanism 31. On the other hand, the guide 170 is adjustable in a horizontal direction to accommodate the width of the conductor 40 that is being processed. It also is raised from the base 172 to clear the space for the conductor 40 so as not to interfere with its movement toward the mandrel 37 during the winding of the coil.

Figure 15:
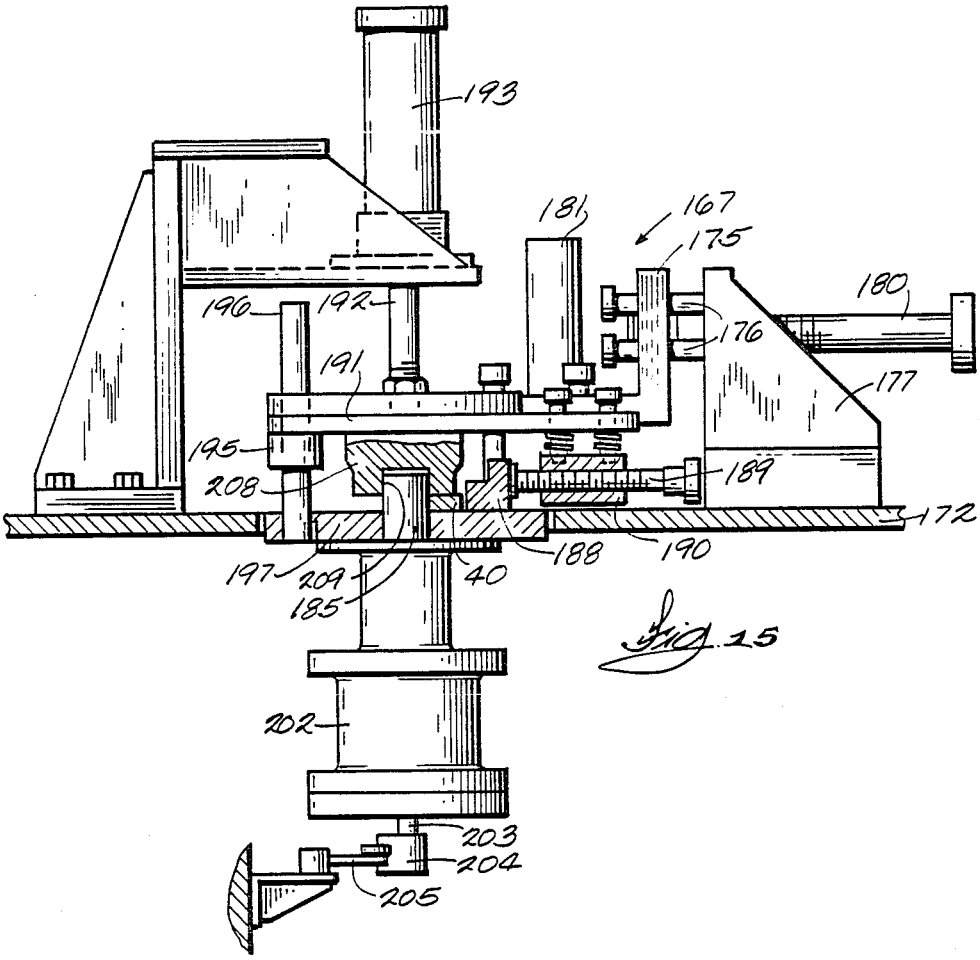
FIG. 15 is a view mostly in elevation taken along the plane represented by the line 15—15 in FIG. 13.

The guide 170 is carried by a bracket 175 that is movable in a horizontal direction. To this end, the bracket 175 is slidable on a pair of rods 176 that are secured to a standard 177 fixedly mounted on the base 172 as best seen in FIGS. 15 and 16. An adjusting screw 180 is in threaded engagement with the standard 177 with its extending end being journaled in the bracket 175. The horizontal position of the guide 170 is adjusted by rotating the screw 180 which, by reason of its threaded engagement with the standard 177 will move the bracket 175 in a horizontal path in either direction to adjust the guide 170 which is carried by the bracket 175. Thus, the location of the guide 170 on the base 172 is movable to adjust the spacing between the guide 170 and 171 to accommodate the size of the conductor 40 being processed.

The guide 170 is also lifted from the base 172 by the operation of a piston and cylinder mechanism 181 which is mounted on a horizontal leg 182 of the bracket 175. The piston and cylinder mechanism 181 includes a piston rod 183 that extends beyond the horizontal leg 182 with its extending end being secured to the guide 170. Thus, by retracting the piston rod 183 into the piston and cylinder mechanism 181 the guide 170 is raised from the base 172. Such movement of the guide 170 is done when the bending of the leading end of the conductor 40 is completed to avoid any interference with the movement of the conductor 40 when the coil is being wound on the mandrel 37.

Figure 14:
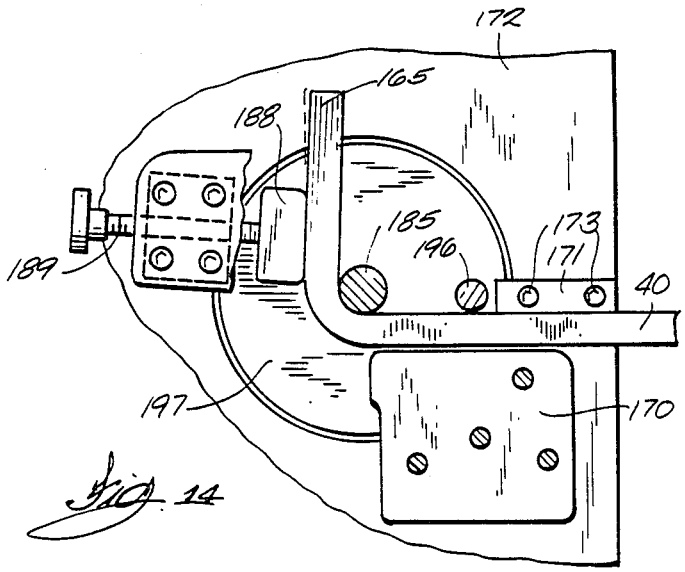
FIG. 14 is a fragmentary plan view with parts broken away showing a portion of the mechanism illustrated in FIG. 13 to show the position of the parts after the bending operation has been completed.

The conductor 40 is positioned between the guides 170 and 171 and then proceeds into the bending area of the bending assembly 167. The bending of the leading end of the conductor 40 takes place about a post 185 which is clearly shown is FIG. 13, 14, and 15. The conductor 40 therefore moves between the vertical post 185 and a pressure block 188 which applies the pressure to the leading end of the conductor 40 to bend it about the post 185 for forming the terminal 165.

The pressure block 188 is carried at the end of a screw 189 that is in threaded engagement with a support 190 that is carried by a plate 191. The plate 191, in turn, is attached to the end of a piston rod 192 that extends from a piston and cylinder mechanism 193. Accordingly, the plate 191 and its attachments may be raised by retracting the piston rod 192 into the piston and cylinder mechanism 193. Of course, in order to return the bending mechanism into operating position, the piston rod 192 is extended from the piston and cylinder mechanism 193.

As best shown in FIG. 15, the plate 191 is supported for sliding movement in a vertical path of travel by a slide bearing 195 slidably mounted on an upstanding post 196. The lower end of the post 196 is secured to a rotary plate 197, the post 196 being located at a distance from the center of the plate 197 so that it moves bodily in an arc with the rotation of the plate 197.

Power for bending the leading end of the conductor 40 is obtained from an electric motor 202 that is coupled to rotate the rotary plate 197 through an angle of 90°. In addition to rotating the plate 197, a drive shaft 203 extends from the opposite end of the motor and is coupled to rotate a dog 204. The dog 204, in turn, actuates a switch 205 for deenergizing the motor after it has rotated the plate 197 through an angle 90°.

During the bending operation, the conductor 40 has a tendency to deform. In order to prevent this a block 208 depends from the plate 191 and is provided with a blind hole 209 as shown in FIG. 15. The hole 209 fits over the post 185 so that its bottom surface overlies the top surface of the conductor 40 to prevent its deformation.

When a bending operation is to be performed, the piston and cylinder mechanism 193 is actuated to move the piston rod 192 outwardly of the cylinder for lowering the plate 191 and its attachments relative to the base 172 until the assembly is in the position illustrated in FIG. 15. The motor 202 is then energized to rotate the plate 197 through an angle of 90°. The rotation of the plate 197 causes movement of the post 196 through an arc which causes rotation of the plate 191 and its attachments about the center of the post 185. Since the pressure block 188 is coupled to move with the plate 191, it too will move in an arc. As it does so it applies pressure to the portion of the conductor 40 extending beyond the post 185 to bend the end of it around the post to the position shown in FIG. 14. While the bending operation is being performed, the conductor 40 remains between the guides 170 and 171 to prevent any deformation of it in that direction.

When the bending operation is completed, the motor 202 is returned to its starting position to thereby return the plate 191 and its associated parts to their original positions. The piston and cylinder mechanism 193 is then energized to retract the piston rod 192 and raise the plate 191 and its attachments out of engagement with the conductor 40.

The operation of the feeding mechanism 32 is halted during the bending operation so that the conductor 40 is not being fed forwardly during this period. When the bending of the leading end of the conductor 40 by operation of the bending assembly 167 is completed, the operation of the feeding mechanism 32 is resumed and the conductor 40 is fed forwardly to the mandrel 37.

Figure 19:
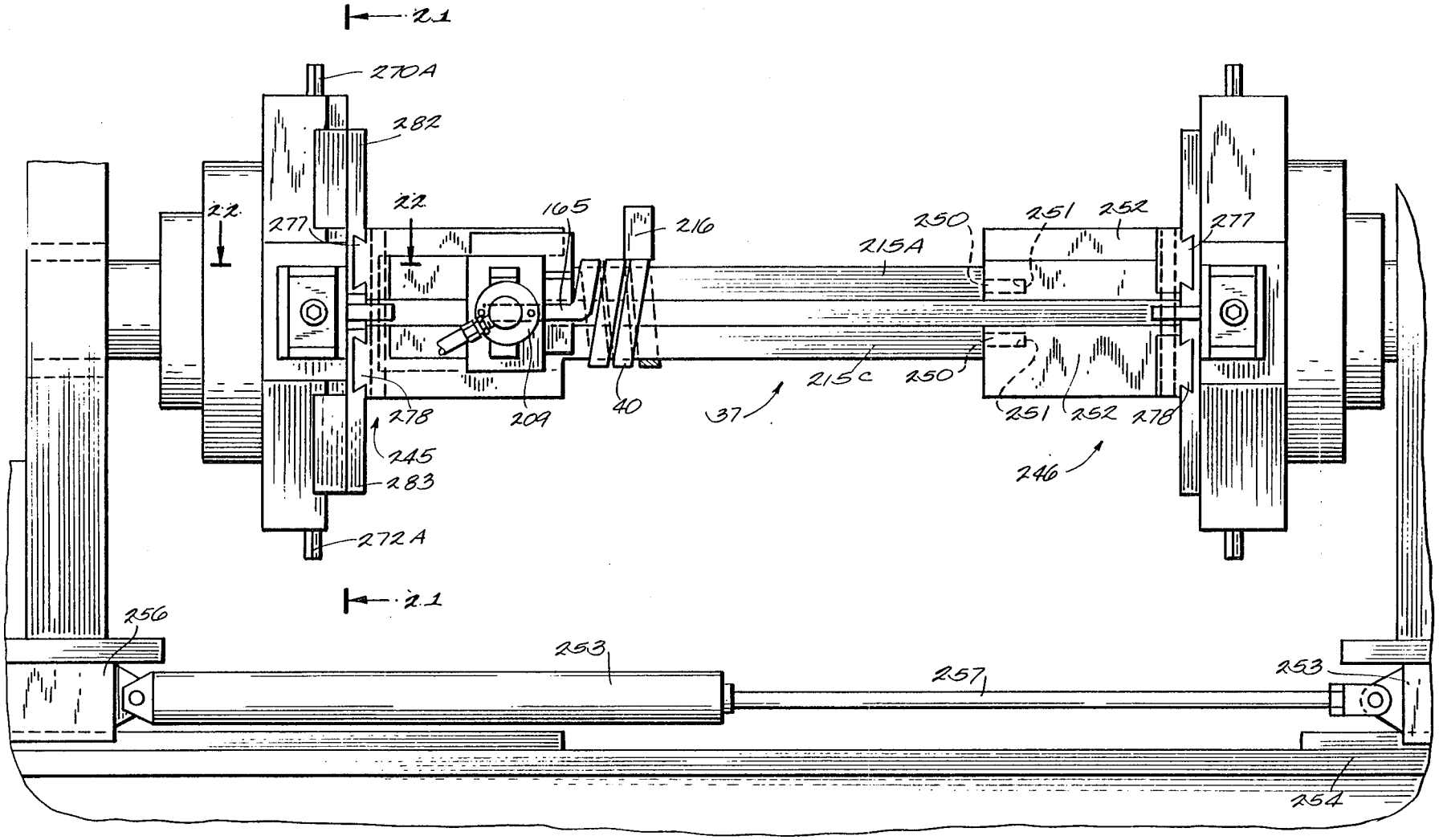
FIG. 19 is an enlarged front elevational view of the mandrel illustrated in FIG. 18 with a coil being shown partly wound upon the mandrel.

The bent leading end of the conductor 40 forming the terminal 165 is moved to a clamp 209 that is mounted on the mandrel as best shown in FIGS. 18 and 19. The clamp 209 is operated to secure the terminal 165 at the leading end of the conductor 40 to the mandrel as illustrated in FIG. 19. As a result, the rotation of the mandrel 37 causes the conductor 40 to be wound about the mandrel in a manner to be later described. Once the cut-off saw 33 has severed the conductor 40 to establish the trailing end of the length of conductor 40 furnished for forming the coil, the length of conductor 40 being employed is separated from the feeding mechanism 37. Further advancement of the conductor 40 is produced solely by the rotation of the mandrel 37 to form the coil drawing the conductor 40 toward the mandrel.

Advancement of the conductor 40 toward the mandrel will bring the trailing end of the conductor 40 to the bending mechanism 168. The forward movement of the conductor 40 will then be temporarily halted to perform the bending operation on the trailing end of the conductor 40 to establish the terminal 166. The bending mechanism 168 is very similar in construction to the bending mechanism 167 and identical parts are identified by the same reference numeral. Moreover, the bending assembly 168 operates in the same manner as the bending assembly 167 except that the trailing end of the conductor 40 is bent in a direction opposite to the direction in which the leading end of the conductor 40 is bent. This is done by rotating the plate 197 of the bending assembly 168 in a direction opposite to the direction of rotation of the plate 197 in the bending assembly 167. As a result, the pressure block 188 moves in an arc with the plate 197 to bend the conductor 40 to form the terminal 166 shown in broken lines in FIG. 13. However, it should be understood, that this does not occur until the terminal 165 of the leading end of the conductor 40 has been clamped to the mandrel 37 and a portion of the coil has been wound about the mandrel.

MANDREL

Figure 27:
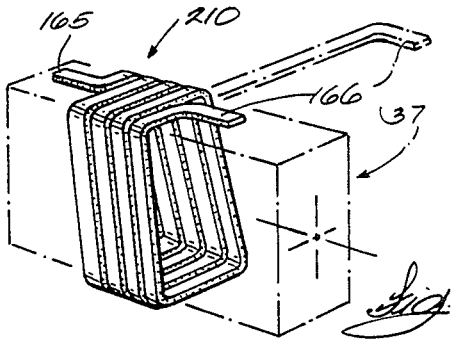
FIG. 27 is a perspective view of a completed coil on the mandrel.

As previously mentioned, after the leading end of the conductor 40 is bent by the bending assembly 167 to form the terminal 165, the conductor 40 is advanced toward the mandrel and positions the terminal 165 in the clamp 209 as shown in FIG. 19. The clamp 209 is actuated to secure the terminal 165 and therefore the conductor 40 to the mandrel 37. With the conductor 40 thus secured to the mandrel 37, the latter is rotated to draw the conductor 40 onto the mandrel for forming the single coil generally identified by the reference numeral 210 and shown in FIG. 27.

Figure 23:
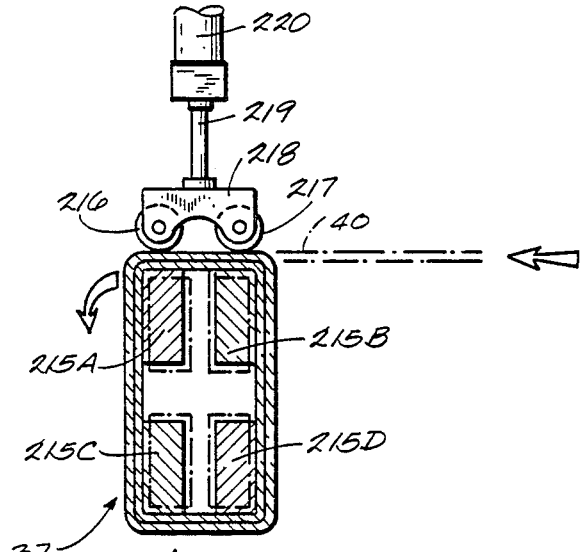
FIG. 23 is a view in vertical section taken along the plane represented by the line 23—23 in FIG. 20.

The mandrel 37 is formed of four longitudinal bars 215A, 215B, 215C, and 215D. These four bars are disposed so that a cross-section through the mandrel 37 defines a rectangle as illustrated in FIG. 23 and which will define the interior of the finished coil 210. The conductor 40 is wound tightly about this rectangular configuration and to this end, the conductor 40 is pressed into tight engagement with the mandrel 37 by two pressure rollers 216 and 217. The rollers 216 and 217 are rotatably supported by a bracket 218 which is secured to the extending end of a piston rod 219. Pressure is applied to the piston rod 219 by a piston and cylinder mechanism 220 which serves to retain the rollers 216 and 217 in engagement with the conductor 40 as it is being wound about the mandrel 37. The rollers 216 and 217 apply pressure to the conductor 40 for tightly winding it about the corners of the mandrel 37 to produce the coil 210 of accurate configuration.

Power for rotating the mandrel 37 is obtained from a motor 225 which drives a belt 226 that is connected to drive a gear reducer 227. The output shaft 228 of the gear reducer 227 is provided with a pulley 229 that drives a belt 230 which is also encircled about a pulley 231.

The gear reducer 227 therefore drives the pulley 231 and the latter is keyed to drive a shaft 232 which is coupled to drive the mandrel 37. The shaft 32 is rotatably supported by a pair of bearings (not shown) mounted in standards 233 and 234. The opposite end of the mandrel 37 is coupled to a shaft 238 which is rotatably supported by bearings (not shown) mounted in standards 239 and 240.

The rotation of the mandrel 37 is stopped by a pair of disk brakes generally identified by the reference numeral 241. A disk brake 241 is provided at each end of mandrel 37 and each brake 241 comprises a disk 242 keyed to rotate with the shafts 232 and 238 respectively The disk 242 is embraced by brake calipers 243 that are fixedly mounted to the standards 234 and 240 as clearly shown in FIG. 18. When the rotation of the mandrel 37 is to be stopped, the calipers 243 are actuated to grip the rotating disk 242 and bring the rotation of the shafts 232 and 238 to a stop.

The mandrel 37 is coupled to the shaft 232 by a coupling assembly generally identified by the reference numeral 245. The opposite end of the mandrel 37 is coupled to the rotary shaft 238 by a coupling assembly generally identified by the reference numeral 246. As previously mentioned, the coil 210 is tightly wound about the mandrel 37 and must be removed therefrom when it is completed. To this end, the mandrel 37 is disengageable from the coupling assembly 246 by moving the entire coupling assembly 246 and the associated supporting structure to the right as viewed in FIG. 18.

The mandrel 37 is placed in driving engagement with the coupling assembly 246 by means of a tongue 250 extending from each of the bars 215A, 215B, 215C, and 215D. The tongues 250 place the mandrel 37 in driving engagement with the coupling assembly 246 by reception in complementary holes 251 formed in movable elements 252 of the coupling assembly 246. The movable members 252 are movable relative to the coupling assembly 246 in the manner to be later described for the purpose of adjusting the spacing of the bars 215A, 215B, 215C, and 215D relative to each other.

Figure 20:
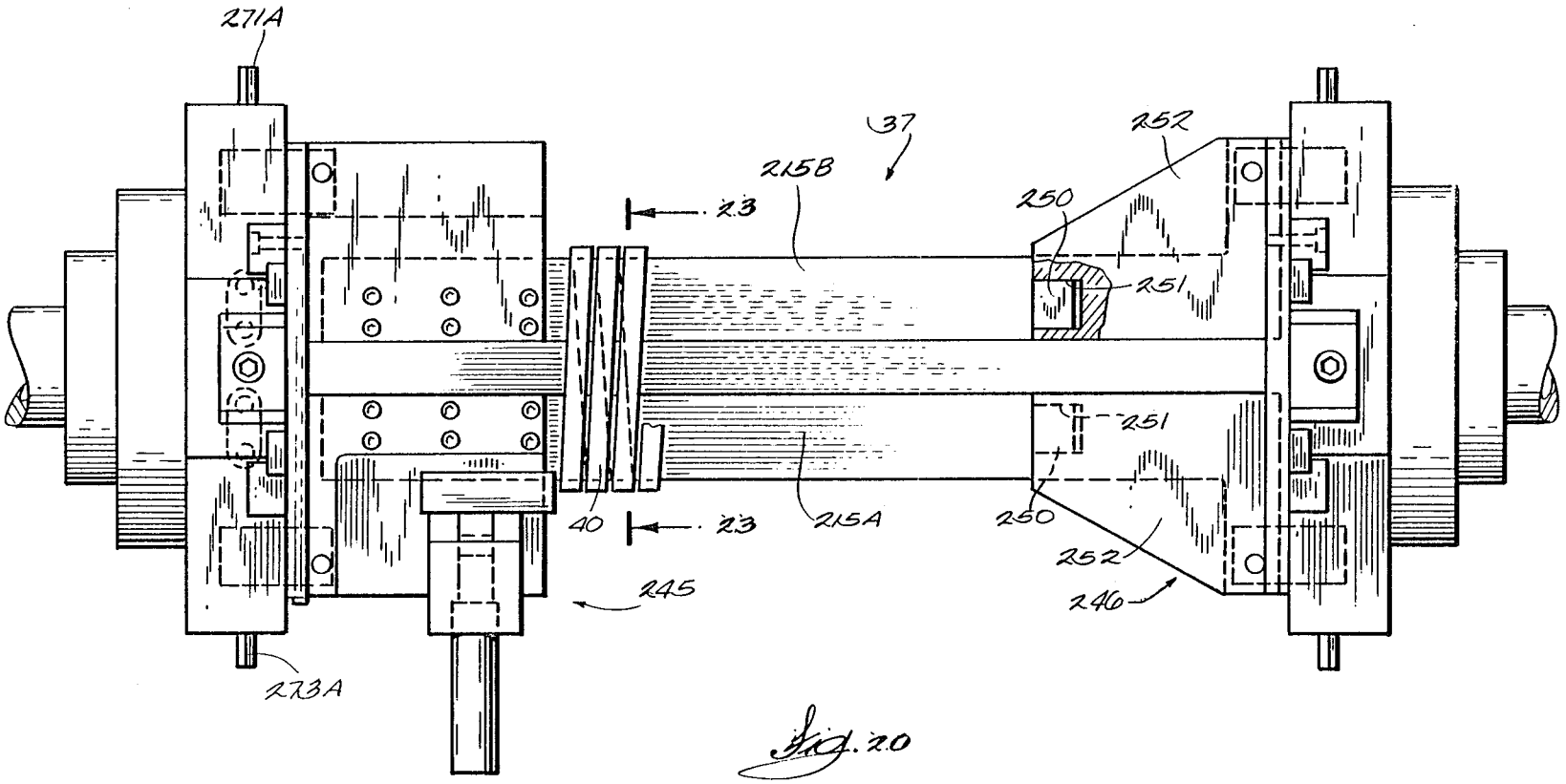
FIG. 20 is a plan view of the mandrel depicted in FIG. 19.

When the coil 210 is being wound about the mandrel 37, the tongues 250 are in engagement with their cooperating holes 251 as shown in FIGS. 18, 19, and 20 so that the mandrel 37 is supported by the coupling assembly 246. However, when the coil is completed and it is desired to remove the coil from the mandrel 37, the coupling assembly 246 is moved to the right from the position shown in FIGS. 18, 19, and 20 to move the holes 251 out of engagement with the tongues 250 to free the right end of the mandrel 37 as viewed in FIGS. 18, 19, and 20 so that the coil 210 may be slid off of the mandrel 37.

In order to render the coupling member 246 movable, the standards 239 and 249 carrying the shaft 238 and the coupling assembly 246 are mounted on a platform 253 that is slidably supported on the base 254. Movement of the platform 253 and therefore of its associated coupling assembly 246 is achieved by actuating a piston and cylinder mechanism 255.

The piston and cylinder mechanism 255 is secured at one end to a platform 256 which is also slidably mounted on the base 254. A piston rod 257 extending from the piston and cylinder mechanism 255 is coupled to the platform 253. Accordingly, by actuating the piston and cylinder mechanism 255 in a direction to extend the piston rod 257, the platform 253 and therefore the coupling assembly 246 will be moved away from the mandrel 37 to disengage the tongues 250 from their cooperating holes 251. The platform 253 may be moved sufficiently to free the end of the mandrel 37 for removing the completed coil 210. After the coil has been removed, the piston rod 257 is retracted into the piston and cylinder mechanism 255 for moving the platform 253 to the left as viewed in FIG. 18 and 19 and thereby move the holes 251 for reception of the tongues 250 to again couple the mandrel 37 to the coupling assembly 246.

In order to obtain the helical windings of the coil 210, the mandrel 37 is moved axially while it is rotating the conductor 40 about its periphery. Such axial movement of the mandrel 37 is obtained by actuating a servo motor 260 illustrated in FIG. 18. The motor 260 rotates a screw 261 which is in threaded engagement with a nut 262 that is secured to the platform 256. Since the platform 256 is slidably mounted on the base 254 the rotation of the screw 261 relative to the nut 262 causes movement of the platform 256 in a horizontal path. The standards 233 and 234 being carried by the platform 256 move with it to produce the axial movement of the mandrel 37.

The platform 256 is connected to the platform 253 by means of the piston and cylinder mechanism 255 and its piston rod 257 so that the platform 253 will move in unison with the platform 256. Therefore, the standards 239 and 240 that are mounted on the platform 253 will move with it to maintain the rotary support of the mandrel 37.

The axial movement of the mandrel 37 must be coordinated with its rate of rotation in order to obtain the desired helical path for the conductor 40. Therefore, servo motor 260 operates under the control of the control circuit 265 and to this end, drives a resolver 264 for providing a feedback to the control. The rate of rotation of the mandrel 37 is likewise regulated by the control circuit 265 and a resolver 266 is driven by the motor 225 to provide a feedback to the control 265.

The winding of the conductor 40 about the mandrel 37 in combination with the pressure applied upon the conductor 40 by the pressure rollers 216 serves to accurately form the coil 210 about the mandrel 37. However, the coils formed by the machine are of different dimensions and therefore the spacing of the bars 215A, 215B, 215C, and 215D must be adjusted accordingly so that the cross-sectional outline of the mandrel 37 conforms to the size of the coil being formed.

Figure 21:
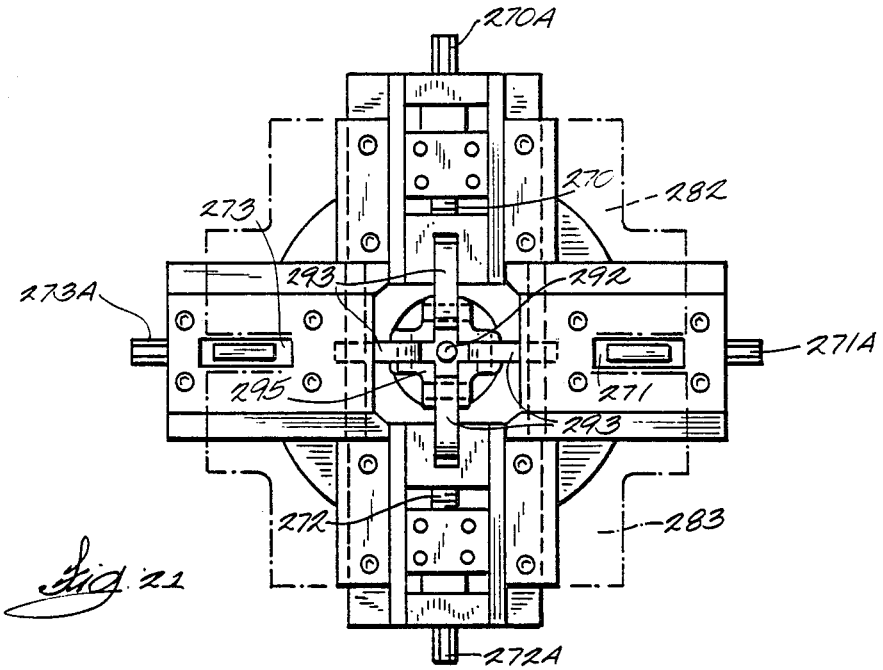
FIG. 21 is a view in vertical section taken along the plane represented by the line 21—21 in FIG. 19.

Such adjustment is made manually by rotating four screws 270, 271, 272, and 273 which are provided with square ends 270A, 271A, 272A, and 273A respectively to facilitate their manipulation as shown in FIG. 21. The two bars 215A and 215C are carried by slides 277 and 278 which provide for adjustment of the bars 215A and 215C in a horizontal direction. The two bars 215B and 215D on the opposite side of the mandrel 37 are carried by similar slides (not shown) to render them movable in a horizontal direction. The opposite end of the bars 215A and 215C are carried by the movable members 252 Which are likewise carried by slides 277 and 278 to render them movable in the horizontal direction to accommodate the adjustment of the bars 215A and 215C.

Movement of the bars in a vertical direction is achieved by means of two slides 282 and 283 as shown in FIG. 21. The slide 282 supports the slide 277 that carries the bar 215A as well as the slide on the opposite side of the mandrel 37 for carrying the bar 215B. The slide 282 is provided with a nut in threaded engagement with the screw 270 so that rotation of the screw will cause movement of the slide 282 in a vertical direction to move both of the top bars 215A and 215B in the vertical direction.

The slide 283 carries the two lower side slides that carry the bars 215C and 215D. The slide 283 is adjusted in a vertical direction by rotating the screw 272 which is in threaded engagement with a nut attached to the slide. This causes movement of the slide 283 either upwardly or downwardly to adjust the two bars 215C and 215D in the same direction.

The screw 273, on the other hand, is in threaded engagement with a nut that is coupled to drive both slides 277 and 278 in a horizontal direction for adjusting both bars 215A and 215C. In like manner, the screw 271 is in threaded engagement with a nut that is coupled to both of the slides that support the bars 215B and 215D for horizontal movement. Rotation of the screw 271 therefore, adjusts the bars 215B and 215D in a horizontal direction to either enlarge the perimeter of the mandrel 37 or reduce it. The opposite ends of the bars 215A, 215B, 215C, and 215D are supported by the movable members 252 which are likewise supported by slides that enable the right ends of the bars as viewed in FIGS. 19 and 20 to move in accordance with the adjustment affected on the left end as viewed in these FIGS.

As previously mentioned, the coil formed on the mandrel 37 is in tight engagement therewith by reason of the action of the pressure rollers 216. If the outside dimensions of the mandrel 37 were not reduced, it would be difficult to remove the completed coil from the mandrel. Therefore, means are provided for reducing the outside dimensions of the mandrel 37 when the completed coil 210 is to be removed therefrom. This is done by retracting the four bars 215A, 215B, 215C, and 215D inwardly a predetermined distance in both directions to reduce the outer dimensions of the mandrel 37. To this end, as shown in FIG. 18, a piston and cylinder mechanism 285 is mounted on the platform 256 on the left side of the mandrel. The piston and cylinder mechanism 285 is provided with a piston rod 286 that has its extending end coupled to a lever 287 that is pivotally supported on a standard 288. The lever 287 is pivotally mounted about a pivot pin 289 that is fixed to the standard 288. The lever 287 extends upwardly from the pivot pin 289 and is provided with a U-shaped opening 290 at its upper end. A pin 291 is horizontally supported in the U-shaped opening 290 and the pin 291 is secured to an actuating rod 292.

Figure 22:
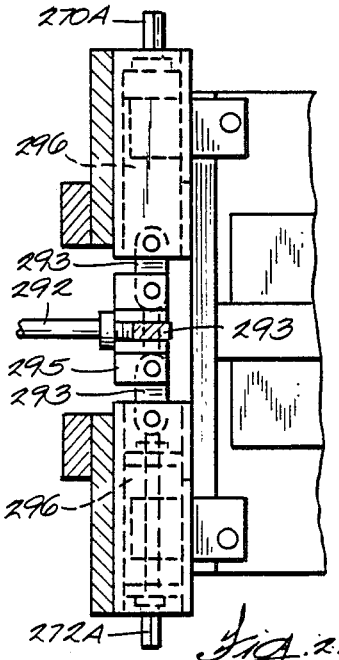
FIG. 22 is a view in horizontal section taken along the plane represented by the line 22—22 in FIG. 19.

Upon the completion of a coil winding operation, the piston and cylinder mechanism 285 is actuated to pivot the lever 287 in a counter clockwise direction to move the pin 291 and its connected rod 292 to the left as viewed in FIG. 18 and thereby move four links 293, two of which are shown in FIG. 22. The links 293 are pivotally connected to an actuating block 295 at one end and to a cooperating link 296 at the opposite end.

Movement of the actuating rod 292 to the left as viewed in FIG. 22 causes a pivotal movement of the links 293 and a rectilinear movement of the cooperating links 296 that are coupled to the four slides described above. The rectilinear movement of the links 296 produces a corresponding movement of the four slides to retract the bars 215A, 215B, 215C, and 215D in both the vertical and horizontal directions in amounts sufficient to release the coil from the mandrel 37.

At the same time that the piston and cylinder mechanism 285 is actuated for retracting the bars 215A, 215B, 215C, and 215D another piston and cylinder mechanism 298 located on the right side of the mandrel 37 on the platform 253 is actuated. The piston and cylinder mechanism 298 actuates the same type of mechanism as does the piston and cylinder mechanism 285. To this end, the piston and cylinder mechanism 298 is provided with a piston rod 301 that has its extending end coupled to a pivotable lever 302. The lever 302 is pivotally supported on a pin 303 that is mounted on a standard 304. The upper end of the lever 302 is provided with a U-shaped opening 305 for receiving a pin 306 that is secured to an actuating rod 307.

Actuation of the piston and cylinder mechanism 298 causes retraction of its piston 301 to move the lever 302 in a clockwise direction about the pivot 303. Such pivotal movement of the lever 302 causes an outward movement of the pin 306 to move the actuating rod 307 a like amount. As previously described for the actuating rod 292, the movement of the rod 307 actuates an actuating block 293 for pivoting four links 293 to actuate the slides for retracting the right side of the four bars 215A, 215B, 215C, and 215D so that both ends of these bars are moved inwardly to reduce the outer dimension of the mandrel 37 and release the completed coil 210.

Figure 24:
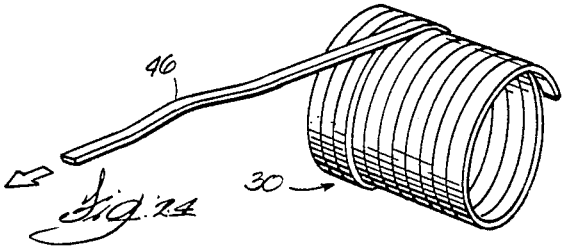
FIG. 24 is a perspective view showing a portion of the conductor having been withdrawn from the supply reel.
Figure 25:
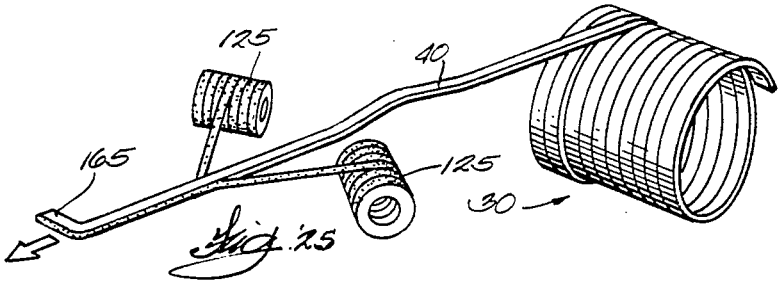
FIG. 25 is a perspective view illustrating the conductor after it has progressed from the position shown in FIG. 24 through the straightening mechanism, the taping system and the bending assembly.
Figure 26:
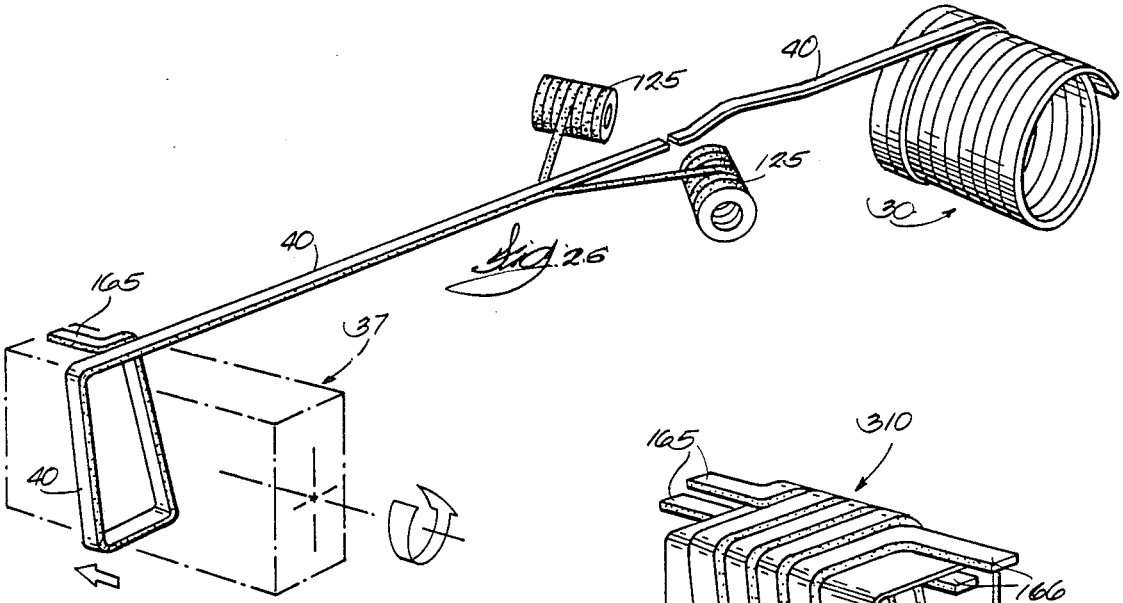
FIG. 26 is a perspective view depicting the conductor progressing further through the machine with its leading end being shown wound about the mandrel to form a portion of the coil.
Figure 28:
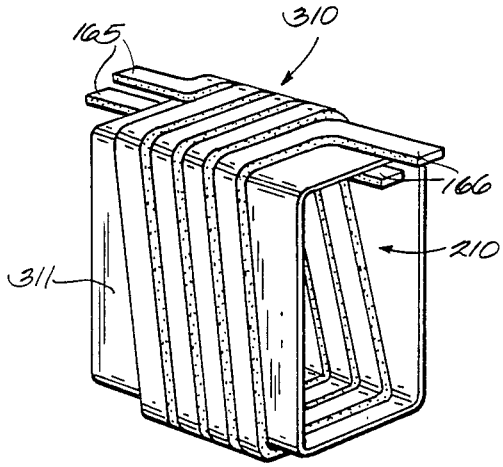
FIG. 28 is a perspective view of a completed coil assembly constituting an outer coil superimposed upon an inner coil with the two individual coils being separated from each other by a sheet of insulating paper.

The FIGS. 24, 25, and 26 illustrate the conductor 40 as it progresses through the machine. FIG. 24 illustrates a length of conductor 40 being withdrawn from the reel 30. The conductor 40 is then straightened as illustrated in FIG. 25 and the tape 125 is applied to both edges of the conductor 40. In addition, the conductor 40 enters the bending mechanism 36 and the terminal 165 is formed on the leading end of the conductor 40.

After the desired length of conductor 40 has passed by the cut-off saw 33, the latter is actuated to sever the conductor 40 as shown in FIG. 26. At this time, the leading end of the conductor 40 is being wound about the mandrel 37 with the terminal 165 clamped thereto. As the mandrel 37 is rotating it is also fed axially so that the conductor 40 is wound in a helical path about the mandrel 37. When the trailing end of the conductor 40 arrives at the bending mechanism 36, it is bent 90° to form the terminal 166. The completed coil is shown wound on the mandrel 37 in FIG. 27.

In actual practice, a second coil 310 is wound over the inner coil 210 and the two coils are separated by a sheet of insulating paper 311 which is manually placed over the inner coil 210 before the winding of the coil 310 begins.

From the foregoing detailed description of the illustrative embodiment set forth herein to exemplify the present invention, it will be apparent that there has been provided an improved coil winding machine for winding bar type conductors into a coil. The machine applies a biasing torque to the supply reel for keeping the conductor taut as it is withdrawn from the reel while at the same time preventing the wheel from overrunning as the conductor is being withdrawn. The conductor proceeds from the reel to a straightening mechanism which straightens the conductor in both directions and also establishes a horizontal plane of reference as well as a vertical plane of reference which is maintained as the conductor progresses through the machine. After the conductor is straightened it enters a feeding mechanism which feeds the conductor forwardly past an encoder that measures the amount of conductor passing through, and when the predetermined amount required for the formation of a coil passes by the encoder, it actuates a cut-off saw which severs the conductor. Tape is applied to both edges of the conductor and the leading end of the length of conductor forming the coil is bent approximately 90° to form one terminal of the coil. This terminal is then transferred to the rotating mandrel which is provided with a clamp for clamping the terminal to the mandrel. The latter then is rotated while it is moved axially to wind the conductor on the mandrel in a helical path. The mandrel is of rectangular cross-section and is formed of four longitudinal bars that are movable both in a horizontal direction and a vertical direction. The four bars are spaced to establish the dimensions of the coil and upon the completion of the coil winding operation are retracted to release the coil from the mandrel. The mandrel is also separable from the supporting structure at one end to provide an opening for the removal of the coil.

Although the illustrative embodiment of the invention has been described in considerable detail for the purpose of disclosing a practical, operative structure whereby the invention may be practiced advantageously, it is to be understood that the particular apparatus described is intended to be illustrative only, and that the various novel characteristics of the invention may be incorporated in other structural forms without departing from the spirit and scope of the invention as defined in the subjoined claims.

The principles of this invention having now been fully explained in connection with the foregoing, I hereby claim as my invention:

1. A coil winding machine for winding an electric conductor into an electric coil for use in electrical apparatus comprising, a frame, a control for regulating the operation of the machine, an electric conductor supply for storing the conductor to be wound into coils, a mandrel mounted in position to receive the conductor from said conductor supply, a clamp on said mandrel adapted to clamp the leading end of the conductor to the mandrel, means connected for rotating said mandrel for winding the clamped conductor about the mandrel, means connected to feed said mandrel axially while it is rotating for winding the conductor about the mandrel in a helical path to form an electric coil and means on said mandrel operable to enable the removal of the completed coil from said mandrel.

2. A coil winding machine according to claim 1 including, measuring means for measuring the length of conductor passing out of said conductor supply toward said mandrel, and cutoff means connected to operate in response to said measuring means for cutting the conductor when the length of conductor measured corresponds to the length required for forming the coil.

3. A coil winding machine according to claim 2, wherein said measuring means comprises an encoder that engages the surface of the conductor to be actuated thereby for producing an encoder signal representing the length of conductor passing through, means connected to transmit said encoder signal to said control, and actuating means in said control responsive to said encoder signal for actuating said cutoff means when the specified length of conductor has passed toward said mandrel.

4. A coil winding machine according to claim 2 including, feeding means operable to withdraw the conductor from said supply and move it into the machine for performing the winding operation, and straightening means supported by the frame in position to receive the conductor from said supply as it is moving through the machine for removing the bends and deformities from the conductor before it is processed in a coil winding operation.

5. A coil winding machine according to claim 1, wherein said conductor supply includes a reel rotatably supported by the frame and having the supply of conductor wound thereon, and biasing means yieldably applying a torque to said reel for opposing the unwinding of the conductor from said reel to maintain the conductor taut and prevent overrunning of said reel.

6. A coil winding machine according to claim 5 including, feeding means operable to overcome said biasing means and withdraw the conductor from said reel and feed it into the machine for performing the coil winding operation.

7. A coil winding machine according to claim 1 including, feeding means operable to withdraw the conductor from said supply and move it into the machine for performing the coil winding operation.

8. A coil winding machine according to claim 7 including, straightening means supported by the frame in position to receive the conductor from said supply as it is moving through the machine for removing the bends and deformities from the conductor before it is processed in an electric coil winding operation.

9. A coil winding machine according to claim 8 including, taping means carried by the frame in position to receive the conductor as it is passing through the machine and apply an insulating tape to the conductor for electrically insulating the individual turns of the completed coil from each other.

10. A coil winding machine according to claim 9 including, bending means carried by the frame in position to receive the conductor after it has been taped by said taping means, said bending means being operable to bend the leading end as well as the trailing end of the length of conductor forming the coil so that the ends of the conductor are bent at an angle to the length of the conductor and will extend from the completed coil to serve as electrical terminals.

11. A coil winding machine according to claim 1 including, straightening means supported by the frame in position to receive the conductor from said supply as it is moving through the machine and remove the bends and deformities from the conductor before it is processed in a coil winding operation.

12. A coil winding machine according to claim 11 including, positioning means in said straightening means positioning the conductor to establish both a vertical plane of reference and a horizontal plane of reference in which the conductor is retained while it is moving through the machine.

13. A coil winding machine according to claim 1 including, taping means carried by the frame in position to receive the conductor as it is passing through the machine and apply an insulating tape to the conductor for electrically insulating the individual turns of the completed coil from each other.

14. A coil winding machine according to claim 13 wherein said taping means applies the insulating tape to both edges of the conductor and bends the tape over the corners so that it overlaps onto the top and bottom surfaces of the conductor.

15. A coil winding machine according to claim 1 including, bending means carried by the frame in position to receive the conductor before it advances to said mandrel, said bending means being operable to bend the leading end of the conductor as well as the trailing end of the conductor at an angle to the length of the conductor so that the ends of the conductor extend from the completed coil to serve as electrical terminals.

16. An electric coil winding machine according to claim 1 including, a pressure roller adapted to apply pressure on the electric conductor as it is being wound about the mandrel to force the conductor into engagement with the mandrel so that the electric coil is formed about the surface of the mandrel and its configuration corresponds to the configuration of the mandrel.

17. A coil winding machine according to claim 1, wherein said mandrel is formed of a plurality of longitudinal sections that are movable relative to each other and including moving means for moving said sections away from each other to expand the cross-sectional dimensions of the mandrel for receiving the conductor and winding it into a coil, said moving means being also operable to retract said longitudinal sections from their expanded position to reduce the cross-sectional dimensions of said mandrel for releasing the finished coil to facilitate its removal from the mandrel.

18. A coil winding machine according to claim 1, wherein said mandrel is split radially so that it is formed of two portions, coupling means engageable to couple said two portions for rotation in unison, and means operable to separate said two portions and thereby disengage said coupling means so that a completed coil may be removed from said mandrel.

19. A coil winding machine according to claim 17, wherein said longitudinal sections are split radially so that each section is formed of two portions, coupling means engageable to couple the two portions of each section so that the mandrel rotates as a unitary structure, and means operable to separate the two portions of each section and thereby disengage said coupling means for opening the mandrel so that a completed coil may be removed from said mandrel.

20. An electric coil winding machine according to claim 1, wherein said control includes means for regulating the rate of rotation as well as the axial feed of said mandrel while it is rotating so that the electric conductor is wound in a predetermined helical path to form the electric coil.

21. A coil winding machine for winding a conductor into a coil formed by a plurality of conductor turns and comprising, a frame, straightening means carried by said frame in position to receive the conductor to be wound and remove bends and deformities from it; guide means in said straightening means fixed to said frame for establishing both horizontal and vertical planes of reference along which the conductor is retained as it passes through the machine; a taping assembly adapted to apply an insulating tape to the edges of the conductor for insulating the turns from adjacent turns in the completed coil; a bending mechanism operable to bend the leading end and the trailing end of the length of conductor employed for each coil so that such bended ends can serve as the terminals for the completed coil; a mandrel mounted in position to receive the conductor from said bending mechanism to form it into a coil; clamp means on said mandrel for clamping the leading end of the conductor to the mandrel; means connected to rotate said mandrel while the leading end of the conductor is clamped to it for winding the conductor about the mandrel, and moving means connected to move said mandrel axially while it is rotating so that the conductor is wound about the mandrel in a helical path to form it into a coil.

22. An electrical coil winding machine for winding an electric conductor into an electric coil for use in electrical apparatus comprising, a frame, a control for regulating the operation of the machine, a reel rotatably supported by said frame and carrying a supply of conductor to be processed by the machine into electric coils, straightening means supported by the frame in position to receive the conductor from said reel and remove the bends and deformities from the conductor before it is processed in a coil winding operation, bending means carried by said frame in position to receive the conductor supplied from said reel, said bending means being operable to bend the leading end as well as the trailing end of the length of conductor forming the electric coil so that the ends of the conductor are bent at an angle to the length of the conductor and will extend from the completed coil to serve as electrical terminals, a mandrel rotatably mounted in said frame in position to receive the conductor from said bending means, a clamp on said mandrel adapted to clamp the leading end of the conductor to the mandrel, means connected for rotating said mandrel for winding the clamped conductor about the mandrel to form the electric coil, and means on said mandrel operable to enable the completed electric coil to be removed from the mandrel.

23. A coil winding machine according to claim 22 including, positioning means in said straightening means positioning the conductor to establish both a vertical plane of reference and a horizontal plane of reference in which the conductor is retained while it is moving through the machine.

24. A coil winding machine according to claim 22 wherein said mandrel is formed of a plurality of longitudinal sections that are movable relative to each other and including moving means for moving said sections away from each other to expand the cross sectional dimensions of the mandrel for receiving the conductor and winding it into a coil, said moving means being also operable to retract said longitudinal sections from their expanded position to reduce the cross sectional dimensions of said mandrel for releasing the finished coil to facilitate its removal from the mandrel.

25. A coil winding machine according to claim 24, wherein said longitudinal sections are split radially so that each section is formed of two portions, coupling means engageable to couple the two portions of each section so that the mandrel rotates as a unitary structure, and means operable to separate the two portions of each section and thereby disengage said coupling means for opening the mandrel so that a completed coil may be removed from said mandrel.

26. A coil winding machine according to claim 22 wherein said mandrel is split radially so that it is formed of two portions, coupling means engageable to couple said two portions for rotation in unison, and means operable to separate said two portions and thereby disengage said coupling means so that a completed coil may be removed from said mandrel.

* * * * *